US006871566B2

(12) United States Patent
Niwayama et al.

(10) Patent No.: US 6,871,566 B2
(45) Date of Patent: Mar. 29, 2005

(54) CAP OPENING SYSTEM AND METHOD FOR OPENING CAP

(75) Inventors: Hiroaki Niwayama, Tokyo (JP); Yasumichi Ida, Tokyo (JP); Yoshiyuki Kojo, Tokyo (JP); Kenichi Miyazaki, Nagano (JP); Hiroyuki Takizawa, Nagano (JP)

(73) Assignees: Aloka Co., Ltd. (JP); Ueda Japan Radio Co., Ltd. (JP)

( * ) Notice: Subject to any disclaimer, the term of this patent is extended or adjusted under 35 U.S.C. 154(b) by 5 days.

(21) Appl. No.: 10/252,353

(22) Filed: Sep. 19, 2002

(65) Prior Publication Data

US 2003/0061911 A1 Apr. 3, 2003

(30) Foreign Application Priority Data

Sep. 20, 2001 (JP) ..... 2001-286346
Sep. 20, 2001 (JP) ..... 2001-286354

(51) Int. Cl.[7] ..... B67B 7/00

(52) U.S. Cl. ..... 81/3.2; 81/3.32; 81/3.33; 81/3.37; 53/381.4

(58) Field of Search ..... 81/3.2, 3.07, 3.25, 81/3.31, 3.32, 3.33, 3.36, 3.37, 3.39; 53/381.4, 300, 331.5, 349, 353, 317

(56) References Cited

U.S. PATENT DOCUMENTS

| | | | |
|---|---|---|---|
| 4,171,650 | A | 10/1979 | Cardinal |
| 4,762,029 | A | 8/1988 | Chen |
| 5,490,321 | A | 2/1996 | Kaneko |
| 5,819,508 | A | 10/1998 | Kraft et al. |
| 6,257,091 | B1 | 7/2001 | Cohen et al. |

FOREIGN PATENT DOCUMENTS

| | | | |
|---|---|---|---|
| EP | 0 497112 A1 | 8/1992 | ..... B37B/7/02 |
| FR | 2014953 | 4/1970 | ..... B67B/7/00 |
| JP | 06008995 | 6/1992 | ..... B67B/7/02 |

*Primary Examiner*—Debra S. Meislin
(74) *Attorney, Agent, or Firm*—Marger Johnson & McCollom, P.C.

(57) ABSTRACT

A cap opening system which can handle various containers having caps and container bodies of different sizes is disclosed. In this system, when a cap of a container is to be opened, a container body of the container is gripped by a container body holding apparatus to raise the container body upward. A top surface of the cap is detected as a reference surface when the cap interrupts an optical beam. Based on the height of the reference surface, the cap is positioned with respect to the cap handling apparatus. Alternatively, a cap receiving member is provided underneath the cap handling apparatus to perform positioning of the cap with respect to the cap handling apparatus.

28 Claims, 16 Drawing Sheets

CAP OPENING SYSTEM AND METHOD FOR OPENING CAP

BACKGROUND OF THE INVENTION

1. Field of the Invention

The present invention is related to a cap opening system and a method for opening a cap, and in particular is related to a system and method for removing a cap provided in the upper portion of a container body of a container.

2. Description of the Prior Art

A cap opening apparatus used in a sample preprocessing system or the like is an apparatus which automatically removes a cap provided in a container such as a test tube or the like. Various cap opening apparatuses have been proposed in the prior art, but any apparatus that can be applied to various types of containers and caps has not yet been put to practical use. Namely, there are a wide variety of container body shapes (lengths in particular) and cap sizes (thicknesses in particular) depending on the type of container. Accordingly, when the operation conditions of the apparatus are fixed or standardized, it is difficult to carry out a cap opening operation for containers having various container bodies and caps. Further, there are push-in caps and screw caps and the like. In the case of a push-in cap, it is preferred that the cap is rotated during the cap opening operation, while in the case of a screw cap, the cap must be rotated for opening it As described above, the prior art cap opening apparatuses can merely raise and lower a container with a cap by a predetermined distance, and operate a holding mechanism or cap grasping mechanism for caps of containers having a predetermined diameter.

Recently, containers having various container bodies and caps are put to practical use, and for this reason there is a demand for a cap opening apparatus which has a relatively simple structure and can automatically adapt its operating conditions to the shape of the container body and the cap of a container even when various containers having different container bodies and caps are supplied to the apparatus.

Further, when one mechanism is provided to grasp the cap and a separate mechanism is provided to rotate the grasped cap, the structure of the apparatus necessarily becomes large and complex. Further, in this case, it is necessary to provide a separate driving source. Furthermore, in the case where caps having various diameters are to be handled, it is desirous that a predetermined grasping force is applied irrespective of the cap diameter and that the cap is rotated at high speed from the point in time when such predetermined grasping force is created, but mechanisms in response to such demand have not yet been realized up to now. The same demand also exists for other apparatuses that need to grasp and rotate objects.

SUMMARY OF THE INVENTION

The present invention is made in view of the problem in the prior art described above. Therefore, an object of the present invention is to provide a cap opening system which can perform a cap opening operation reliably.

Another object of the present invention is to provide a cap opening system which can be used for various containers having caps of different sizes.

Still another object of the present invention is to provide a cap opening system equipped with a cap handling apparatus in which a cap is first grasped and then the cap is rotated.

Yet another object of the present invention is to provide a cap opening system equipped with a cap handling apparatus in which a force for grasping a cap and a force for rotating the cap are provided by a single driving source.

A further object of the present invention is to provide a cap opening system equipped with a cap handling apparatus in which the cap is rotated after a constant grasping force is produced irrespective of the size of the cap to be grasped.

In order to achieve the objects stated above, the present invention is directed to a cap opening system for automatically opening a cap of a container which includes a container body and the cap attached thereto. The cap opening system comprises a container body handling apparatus for holding the container body of the container to raise and lower it, a cap handling apparatus arranged above the container body handling apparatus for grasping and then opening the cap of the container when the container body is raised, and positioning means for positioning the cap with respect to the cap opening apparatus.

According to the above structure, the container body is held by the container body handling apparatus and then it is raised upward. Then, the cap is positioned with respect to the cap handling apparatus, and then a cap opening operation is carried out. In this invention, since such positioning means is provided, it is possible to position the cap properly with respect to the cap handling apparatus irrespective of the thickness of the cap and the length of the container body.

Preferably, the positioning means positions the cap with respect to the cap handling apparatus based on the reference surface of the cap. Further, preferably, the reference surface is a top surface of the cap. Since the cap handling apparatus grasps a portion of the cap below the top surface therof, it is quite reasonable that the top surface of the cap is used as the reference surface.

Preferably, the positioning means includes a cap receiving member to which the top surface of the cap is adapted to abut, said cap receiving member being arranged below the cap handling apparatus, in which the positioning of the cap is carried out by abutting the top surface of the cap against the cap receiving member. In this arrangement, because the positioning is carried out using the abutment of two parts, positioning can be carried out reliably with a simple structure.

In this case, it is preferred that the cap receiving member has a central portion and a peripheral portion, in which a concave part is formed in the central portion and an extending part which extends downward is formed in the peripheral portion thereof. In this arrangement, the top surface of the cap abuts against the lower surface of the extending part. In this case, it is preferred that the concave part has size and shape that can receive a protruding portion of the cap which protrudes upward from the central portion of the top surface of the cap.

Further, it is also preferred that the container body handling apparatus includes an abutment detecting device for detecting abutment of the top surface of the cap against the cap receiving member, and a control section for stopping the raising operation of the container body when the abutment detecting device detects the abutment. In this arrangement, it is also preferred that the cap opening system includes buffer means for damping impact by the abutment when the top surface of the cap abuts against the cap receiving member.

Furthermore, it is also preferred that the cap opening system further comprises a first sensor which emits a vertical optical beam along the raising and lowering path of the cap, a second sensor which emits a horizontal optical beam which intersects the raising and lowering path of the cap at a predetermined height, and means for determining the presence or absence of the cap based on the outputs of the first and second sensors. In this arrangement, the raising operation of the container body is stopped when the horizontal optical beam is interrupted, and in this state the presence or absence of an object within a predetermined range in height is detected utilizing the vertical optical beam.

In this arrangement, it is preferred that the first sensor is positioned above the container body at least before the cap opening operation is carried out. In this case, it is also preferred that the first sensor is positioned above the container body again when the cap opening operation has been carried out.

Another aspect of the present invention is directed to a cap opening system for automatically opening a cap of a container which includes a container body and the cap attached thereto. The cap opening system comprises a container body handling apparatus for holding the container body to raise and lower it, a reference surface detector which detects a reference surface of the cap of the container when the container body is raised upward by the container body handling apparatus, a cap handling apparatus for grasping and then opening the cap of the container, and means for controlling the operations of the container body handling apparatus and the cap handling apparatus to position the cap with respect to the cap handling apparatus based on the detected reference surface.

According to the above structure, the container body is held by the container body handling apparatus and then it is raised upward. At that time, the reference surface of the cap is detected by the reference surface detector. Then, based on the height of the reference surface, the cap is positioned with respect to the cap handling apparatus at a predetermined proper height. As described above, according to this arrangement, the level of the reference surface is detected individually. Therefore, even if there is a wide variety of cap thickness or container body length, it is possible to carry out proper positioning of such caps with respect to the cap handling apparatus within a certain degree. In other words, when a cap is grasped by the cap handling apparatus, a proper grasping position can be set. In this connection, it is to be noted that although it is preferred that the positioning of the cap is carried out by adjusting the height of the cap itself, such positioning may be done by adjusting the height of the cap handling apparatus.

Preferably, the reference level is the top surface of the cap. This is effective because detection of the top surface can be made relatively easily, and because the cap is grasped at its middle portion below the top surface.

Preferably, the reference surface detector includes a light emitting element and a light receiving element arranged at opposite sides of the raising and lowering path of the cap so that an optical beam is run between the light receiving and light emitting elements, in which the top surface of the cap is detected utilizing the interruption of the beam by the cap. According to this arrangement, the reference level can be detected reliably with a relatively simple structure.

In this case, it is preferred that the top surface of the cap has a central portion and a peripheral portion which is located at a position shifted from the central portion in the horizontal direction, in which the light receiving and light emitting elements are arranged so that the beam is run across the peripheral portion, thereby enabling to detect the top surface of the cap irrespective of the shape of the central portion of the top surface of the cap. This arrangement is particularly preferred for the type of cap having a protruding portion on its central portion of the top surfaces thereof, since it is possible to avoid the case that such a protruding portion is miss-recognized as the reference surface.

Further, it is preferred that the control section sets the height at which the reference surface is detected by the reference surface detector as a reference level and then raises the container body by a predetermined distance, thereby positioning the cap with respect to the cap handling apparatus. In this arrangement, the predetermined distance is preferably set to be a fixed distance, but it may be changed depending on the situations.

Further, it is also preferred that the cap opening system further comprises a cap presence or absence detector for detecting presence or absence of the cap. This makes it possible to increase the reliability of the detected result of the reference surface detector.

In this case, it is also preferred that the cap presence or absence detector is positioned above the container body at least before the cap opening operation is carried out. According to this arrangement, it is possible to avoid the case that the upper edge of the container body is miss-recognized as the reference surface when no cap is attached to the container body.

Further, it is also preferred that the cap presence or absence detector is positioned above the container body again when the cap opening operation has been carried out. According to this arrangement, it is also possible to confirm whether or not the cap is opened. In this case, such confirmation may be done using the reference surface detector alone or in combination with other detector.

In this arrangement, it is preferred that the cap presence or absence detector includes a reflection type optical sensor which detects the presence or absence of an object within a predetermined range in height. According to this arrangement, it is possible to confirm the presence of the cap by carrying out detection at the time when the reference surface is detected or before or after that time. Further, it is preferred that the predetermined range in height is set to the range where the reference surface may lie therein taking variety in thickness of caps or length of container bodies into account. This makes it possible to avoid the case where a liquid surface in a container body is miss-recognized as a cap.

In the cap opening system, it is preferred that the container body handling apparatus comprises a pair of holding mechanisms, which are arranged opposite to each other so as to be capable of advancing or retracting, for holding a container body of a container which is supported by a rack from opposite sides of the container body; and a raising and lowering mechanism for raising and lowering the pair of holding mechanisms. According to this arrangement, since the distance between the pair of holding mechanisms can be relatively freely set, it becomes possible to hold or grip various container bodies having different diameters to a certain extent. Namely, this arrangement makes it possible for the system to handle a wide variety of containers having caps and containers of difference sizes in addition to the advantage obtained by the positioning of caps based on the reference levels thereof.

In this cap opening system, it is also preferred that the cap handling apparatus comprises a clamp mechanism for holding the cap, and a driving mechanism for driving the clamp mechanism so that the clamp mechanism is opened and closed with being rotated. According to this arrangement, since the clamp mechanism can perform grasping operation for various types of caps having different diameters and the clamp mechanism can be rotated, this structure can also be applied to containers having screw caps (screw tops). Further, in this arrangement, the system may be controlled that the clamp mechanism is raised and/or the container body is lowered while the cap is being rotated.

Furthermore, in this invention, it is also preferred that the cap opening system further comprises a movable member on which the cap handling apparatus is mounted; and means for driving the movable member so as to position the cap handling apparatus above the container body which is held by the container body handling apparatus when the cap is to be opened while positioning the cap handling apparatus above a cap disposal section when disposing of the cap.

According to this arrangement, a cap opening operation by the cap handling apparatus and disposal of caps can be made by driving the movable member, that is it is possible to move the cap handling apparatus between two positions with a simple structure.

In this case, it is preferred that the movable member includes a rotary plate which is rotatable between a first angular position and a second angular position, in which the rotation angle of the rotary plate is set at the first angular position when the cap is to be opened and the rotation angle of the rotary plate is set at the second angular position when disposing of the cap.

Further, it is also preferred that the cap presence or absence detector is mounted on the rotary plate, in which when the rotary plate is in the first angular position, the cap presence or absence detector is positioned at its evacuated position, while when the rotary plate is in the second angular position, the cap presence or absence detector is positioned above the container body held by the container body handling apparatus.

In the present invention, it is preferred that the cap handling apparatus comprises a base frame; a rotary unit rotatably provided with respect to the base frame; a plurality of arms provided on the rotary unit for grasping the cap; and a brake mechanism for restricting the rotation of the rotary unit, wherein the rotary unit comprises a rotary frame, a rotation shaft which is a shaft rotatably driven and provided so as to be capable of advancing or retracting with respect to the rotary frame with being biased toward the advancing direction, said rotation shaft includes an engagement part which is to be engaged with the brake mechanism to release its rotation restricted state at a retracting position thereof, and a screw part; and a cam member threaded onto the screw part, and said cam member is adapted to move in an advancing direction by the forward rotation of the rotation shaft in the rotation restricted state of the rotary unit to cause the plurality of arms perform the grasping operation, and adapted to stop the advancing movement after the grasping operation has been completed to convert the forward rotational movement of the rotation shaft into a retracting movement of the rotation shaft, wherein by the forward rotational movement of the rotation shaft, the plurality of arms first perform the grasping operation and then the plurality of arms are rotated.

According to the above arrangement, when the cam member is retracted relative to the rotation shaft, the plurality of arms are in an open state (or a release state) and rotation of the rotary unit is restricted by the brake mechanism. When the rotation shaft is rotated forward from this state, the cam member is advanced relative to the rotation shaft due to threading engagement between the screw part of the rotation shaft and the cam member, and then according to the advancing movement of the cam member, the plurality of arms perform the grasping operation. When the grasping operation for the cap by the plurality of arms have been completed, the cam member is no longer possible to advance even by the forward rotation of the rotation shaft, and because of this, the rotation shaft itself begins the retracting movement by the forward rotation of the rotation shaft. Then, the engagement part of the rotation shaft comes to abutment with the brake mechanism to release the rotation restricted state by the brake mechanism. In this state, the rotary unit is rotated forward by the forward rotation of the rotation shaft. Namely, the plurality of arms are rotated forward as well as the cap is also rotated forward. As described above, according to this arrangement, only by the forward rotation of the rotation shaft, the grasping operation is first performed, and subsequently when the grasping operation is completed, the rotation of the rotary unit (the plurality of arms) is carried out. In this way, the sequential operations described above can be performed with a single driving source.

In this arrangement, the base frame is preferably constructed from a hollow outer casing, and the rotary unit is rotatably provided inside the outer casing through a bearing mechanism or the like. Further, the rotary frame is preferably constructed from a hollow inner casing, and the rotation shaft onto which the cam member is threaded is provided along the central axis of the inner casing.

Further, in this arrangement, it is preferred that the cam member is formed with an inclined surface on which a driving end of each arm slidably contacts, in which the driving ends of the respective arms are moved on the inclined surface according to the advancing movement of the cam member so that operating ends of the respective arms are operated so as to be closed.

According to this arrangement, one end of each arm functions as a driving end, and the other end of the arm (that is, an end of the arm that grasps a cap) functions as an operating end. When the driving ends of the respective arms are slidably moved along the inclined surface, the driving ends of the arms are gradually far away to each other in the horizontal direction, and at the same time, the operating ends of the arms are operated so as to be closed, that is grasping operation is performed. In this case, it is preferred that the length of the inclined surface is determined taking the upper and lower limits of diameters of caps to be handled into account.

Further, in this arrangement, it is preferred that the brake mechanism comprises a brake plate, and biasing means which biases the brake plate in the advancing direction of the rotation shaft, wherein the rotation of the rotary unit is being restricted during the state that the brake plate is in contact with the rotary frame. The biasing means may be formed from one or more springs, for example, and basically, the biasing force of the biasing means provides the grasping operation completing state (that is, a state that a predetermined grasping force is exhibited). In other words, the rotational force transmitted to the rotation shaft after the grasping operation is completed will not be utilized for increasing the grasping force, and such force is utilized for retracting the rotation shaft to release the brake.

Preferably, the brake plate comes to release from the rotary frame from the point of time that a force caused by the retracting movement of the rotation shaft after the conversion exceeds the biasing force of the biasing means, thereby the rotation restricted state of the rotary frame is released.

According to this arrangement it is possible to generate a constant grasping force irrespective of sizes of caps, and it is also possible to rotate the cap automatically from the point of time that a predetermined grasping force is generated.

In this arrangement, it is also preferred that the cap opening system further comprises rotation preventing means for restricting rotation of the rotary unit when the plurality of arms are operated so as to release the grasping cap, wherein by the reverse rotation of the rotation shaft, the cam member carries out the retracting movement relative to the rotation shaft and the rotation shaft carries out the advancing movement.

According to this arrangement, it becomes possible to overcome a problem in that the cam member can not be retracted and returned to the original position since the rotary unit itself is also rotated by the reverse rotation of the rotation shaft when the cap is to be released. The reverse rotation of the rotation shaft is immediately transmitted to the cam member so that the cam member begins its retracting movement. In this regard, it is to be noted that during the reverse rotation of the rotation shaft, the rotation shaft is advanced by the biasing force to be returned its original position.

In this arrangement, it is preferred that the rotation preventing means includes a polygonal member provided on the rotary unit, and a plurality of abutment members which abut the polygonal member to prevent its rotation.

In this case, the polygonal member may be a triangle member provided horizontally, wherein the rotation of the triangle member can be prevented (stopped) when two of three edges of the triangle member are abutted to two abutment members. Of course, as for the preventing means, other various means can be adopted so long as the rotation of the rotary unit is prevented when releasing the cap.

Further, it is also preferred that the rotary unit may be provided with a positioning member to which the cap is to be abutted. According to this arrangement, positioning of the cap can be made by abutting the cap against the positioning member.

The other aspect of the present invention is directed to a method for opening a cap of a container which has a container body and the cap attached thereto, the method being applicable to various containers having caps of various thicknesses and container bodies of various lengths. This method comprises the steps of positioning a cap of a container by raising a container body of the container to cause a reference surface of the cap to be abutted to a cap receiving member, and removing the cap which has been positioned from the container body.

Furthermore, other aspect of the present invention is directed to a method for opening a cap of a container which has a container body and the cap attached thereto, the method being applicable to various containers having caps of various thicknesses and container bodies of various lengths. This method comprises the steps of detecting a reference level of a cap attached to a container body; positioning the cap based on the reference level of the cap; and removing the cap which has been positioned from the container body.

It is to be noted that the cap opening system and method for opening a cap according to the present invention described above can be also applied to containers having similar caps and container bodies as well as containers having the same caps and container bodies.

These and other objects, structures and advantages of the present invention will be more apparent when the following detailed description of the embodiments is considered in conjunction with the appended drawings.

DETAILED DESCRIPTION OF THE PREFERRED EMBODIMENTS

The preferred embodiments of the present invention will be described below with reference to the drawings.

Figure 1:
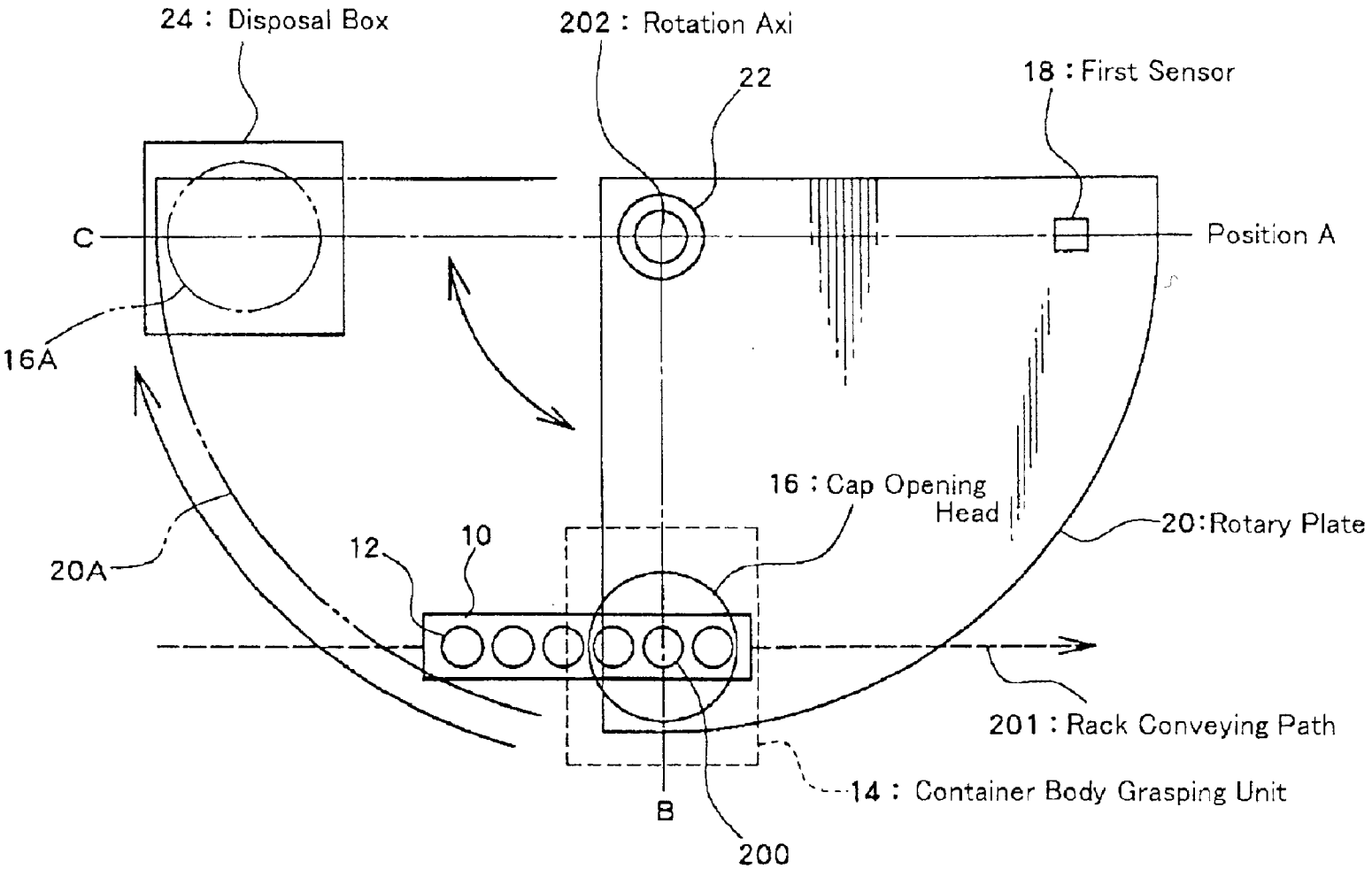
FIG. 1 is a top schematic view which shows the structure of a cap opening system according to the present invention.

FIG. 1 is a top schematic view of the structure of a cap opening system according to the present invention. This cap opening system removes the cap provided on the upper opening of a container body 12 such as a test tube or the like supported by a rack 10, and then discards such cap. In FIG. 1, the rack 10 is conveyed along a rack conveying path 201. The conveying of the rack 10 is carried out by a rack conveying mechanism (not shown in the drawing). The container body 12 provided with a cap to be opened is positioned at a cap opening position indicated by the reference numeral 200.

In the present embodiment, a fan-shaped rotary plate (which is a movable member as claimed) 20 is provided above the rack 10. The rotary plate 20 rotates 90 degrees about a rotation axis 22. The rotation of the rotary plate 20 is carried out by a rotary plate driving section not shown in the drawing. In this connection, in FIG. 1, the rotation axis of the rotary plate 20 is represented by the reference numeral 202.

A cap opening head 16 is mounted to one side of the rotary plate 20 in a fixed state. As described later with reference to FIG. 6, the cap opening head 16 grasps and then rotates the cap attached to the container body 12, and this cap opening head 16 forms a mechanism for carrying out a cap opening operation (that is, a cap handling apparatus as claimed). On the other hand, a first sensor 18 for detecting the presence or absence of a cap is provided on the other side of the rotary plate 20. An example of the specific structure of the first sensor 18 is described later with reference to FIG. 3 and the like. In the embodiment shown in FIG. 1, the first sensor 18 and the cap opening head 16 are provided at positions shifted 90 degrees with respect to the rotation axis 202, but the present invention is not limited to this structure.

In the present embodiment, in the state where the first sensor 18 is at position A and the cap opening head 16 is at position B, when the rotary plate 20 is rotated 90 degrees clockwise, the cap opening head 16 is positioned above a disposal box 24, namely, the cap opening head 16 reaches position C, and in this state, the first sensor 18 is positioned at position B. The rotary plate 20 in this state is represented by the reference character 20A in FIG. 1. Further, the cap opening head 16 in this state is represented by the reference character 16A. Please note that the disposal box 24 is a container for receiving opened caps.

When the above process is described more specifically by focusing the cap opening operation, first, in order to detect the presence or absence of a cap, the first sensor 18 is positioned at position B, and in this state, the cap opening head 16 is, evacuated to position C. Then, the rotary plate 20 is rotated 90 degrees counterclockwise, and in this state, the first sensor 18 is evacuated to position A, and the cap opening head 16 is positioned above the cap opening position 200. Namely, the cap opening head 16 is positioned at position B. In this state, the cap opening operation is carried out, and then after the cap has been opened, the cap opening head 16 is moved again to position C, and then the removed cap is discarded into the disposal box 24. Then, these alternating rotational operations are repeatedly carried out.

As shown in FIG. 1, a container body grasping unit 14 is provided in a fixed state at the cap opening position 200. As will be described in detail later with reference to FIG. 3, the container body grasping unit 14 grasps the container body 12 and then raises it, and this forms a mechanism for positioning the cap provided in the container body 12 with respect to the cap opening head 16. In this regard, it is to be noted that the container body grasping unit 14 is an example of "container body handling apparatus" in the appended claims.

As will be described below, in the present embodiment, the container body grasping unit 14 and the cap opening head 16 are provided with various means that enable the cap opening system to be applied to container bodies having various lengths and diameters, and caps having various thicknesses and diameters.

Figure 2:
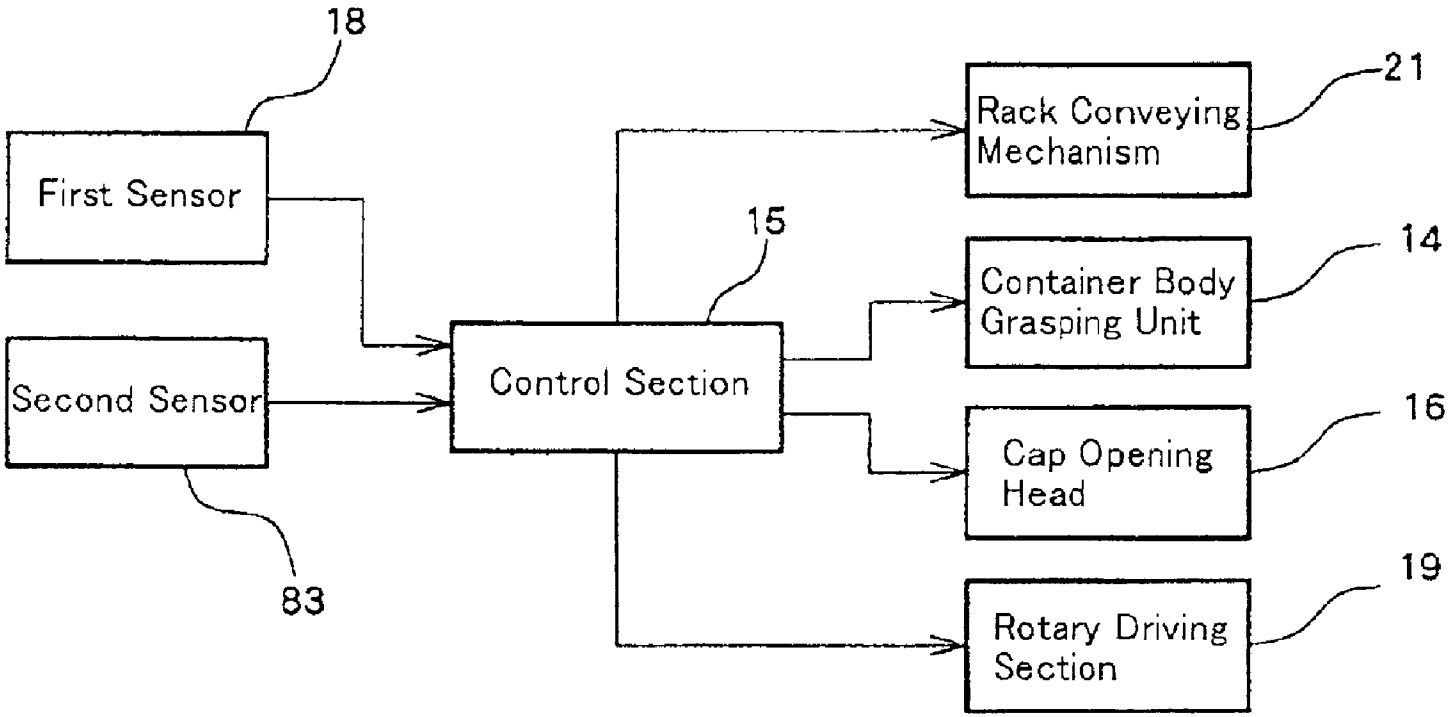
FIG. 2 is a functional block diagram for explaining the overall structure of the cap opening system according to the present invention.

FIG. 2 is a functional block diagram of the overall structure of the cap opening system according to the present embodiment. As shown in FIG. 2, a control section 15 controls the operations of the various elements in the present system, and the control section 15 is constructed for example from a microcomputer or the like. As shown in FIG. 1, when the container body 12 is raised upward at the cap opening position 200, the first sensor 18 detects whether or not a cap is actually provided in the container body 12. Further, in the present embodiment, the first sensor 18 can also be utilized to confirm whether or not the cap has been removed after the cap opening operation has been carried out. As will be described later, the first sensor 18 is for example a reflection type optical sensor which detects the presence or absence of an object within a predetermined distance range, and the detection results thereof are outputted to the control portion 15.

As will be described later with reference to FIG. 3, the cap opening system is provided with a second sensor 83 which detects the top surface of the cap as a reference surface when the container body 12 is held and raised upward. In the present embodiment, the second sensor 83 is arranged at a predetermined height (origin height for control), and is constructed from a light emitting element which emits an optical beam in the horizontal direction and a light receiving element which receives the beam, which are respectively arranged on opposite sides of the upward conveyance path (the rising and lowering path) of the container body 12. In this way, by detecting the top surface of the cap, namely, the reference surface, it is possible to always recognize the reference height of the cap even when there is a wide variety of container body lengths and cap thicknesses. Accordingly, it is possible to set the proper grasping position at a position lying a predetermined distance below the top surface of the cap. Namely, it is possible to position the cap properly with respect to the cap opening head 16 shown in FIG. 1. The output signal of the second sensor 83 is outputted to the control section 15. The control section 15 controls the cap opening operations based on the output signals from the first sensor 18 and the second sensor 83.

Further, as shown in FIG. 2, the control section 15 controls the operations of a rack conveying mechanism 21, the container body grasping unit 14, the cap opening head 16 and a rotary driving section 19. In this regard, the rack conveying mechanism 21 is a mechanism for conveying the rack 10 along the rack conveying path 201 shown in FIG. 1, and the container body grasping unit 14 functions as the container body handling apparatus. Further, the cap opening head 16 functions as the cap handling apparatus as described above, and the rotary plate driving portion 19 is constructed from a motor and the like for driving the rotary plate 20 shown in FIG. 1. Of course, in addition to the elements shown in FIG. 2, the cap opening system according to the present embodiment includes various other elements not shown in FIG. 2 or the other drawings. In this connection, it is to be noted that this cap opening system may be incorporated as a part of a sample preprocessing apparatus.

Figure 3:
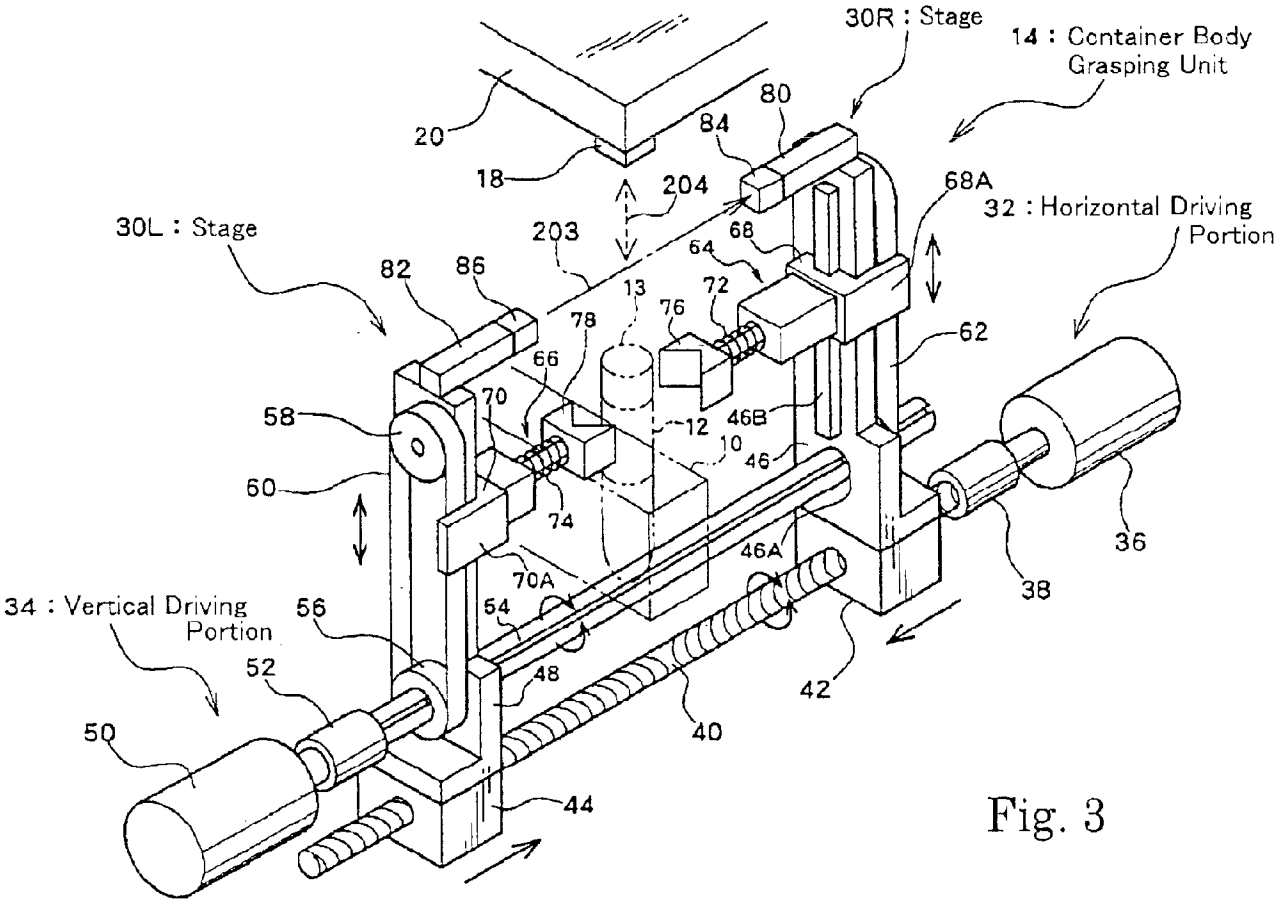
FIG. 3 is a perspective view which shows the structure of a container body handling apparatus of the cap opening system.

FIG. 3 shows an example of the specific structure of the container body grasping unit (container body handling apparatus) 14 described above. The container body grasping unit 14 includes a pair of stages 30R, 30L arranged on opposite sides of the rack 10, namely, on opposite sides of the container having a cap to be opened. Further, the container body grasping unit 14 includes a horizontal driving portion 32 which functions as a means for driving the pair of stages 30R, 30L in the horizontal direction so that the stages 30R, 30L are moved toward each other or away from each other. Further, the container body grasping unit 14 includes a vertical driving portion 34 which drives holding mechanisms 64, 66 respectively provided on the pair of stages 30R, 30 in the upward and downward directions. A detailed description of these elements is given below.

First, a description will be given for the horizontal driving portion 32. A feed screw 40 is coupled to the rotation shaft of a motor 36 via a coupling 38. The feed screw 40 extends in a direction orthogonal to the rack conveying path, and nut blocks 42, 44 are screwed onto the feed screw 40. The right and left sides of the feed screw 40 are formed with mutually opposite directed threads, whereby when the feed screw 40 is rotated in one direction, the nut blocks 42, 44 are moved toward each other, and when the feed screw 40 is rotated in the other direction, the two nut blocks 42, 44 are moved away from each other. In this regard the nut blocks 42, 44 respectively function as pedestals of the stages 30R, 30L.

Next, a description will be given for the vertical driving portion 34. The rotation shaft of a motor 50 is coupled to a spline shaft 54 via a coupling 52. The spline shaft 54 transmits rotational force for moving the two holding mechanisms 64, 66 in the upward and downward directions while allowing movement of the stages 30R, 30L in the horizontal direction. In the example shown in FIG. 3, the stages 30R, 30L include frames 46, 48 which are fixedly mounted to the nut blocks 42, 44, respectively, so that these frames 46, 48 extend upward from the nut blocks 42, 44.

A bearing 46A and a bearing (for the stage 30L, not shown in the drawing) are provided respectively on the lower portions of the frames 46, 48 through which the spline shaft 54 is inserted. A freely rotatable drive roller 56 and a freely rotatable drive roller (for the stage 30R, not shown in the drawing) are provided respectively on the stages 30L, 30R, and when the spline shaft 54 is rotated, the drive roller 56 of the stage 30L and the drive roller of the stage 30R are rotated. Further, a freely rotatable driven roller 58 and a freely rotatable driven roller (for the stage 30R, not shown in the drawing) are provided respectively on upper portions of the stages 30L, 30R. Further, a belt 60 is suspended between the drive roller 56 and the driven roller 58 of the stage 30L, and a belt 62 is suspended between the drive roller and the driven roller of the stage 30R. Accordingly, when the rotation shaft of the motor 50 is rotated, the belts 60, 62 are moved in accordance with the direction of such rotation, respectively.

The holding mechanisms 64, 66 described above are mounted respectively to the stages 30R, 30L. These holding mechanisms 64, 66 respectively include sliding blocks 68, 70 and holding members 76, 78 having V-shaped chucking grooves formed therein. The sliding blocks 68, 70 respectively slide up and down along a rail 46B provided on the frame 46, and a rail (not shown in the drawing) provided on the frame 48. Further, the sliding blocks 68, 70 respectively include coupling portions 68A, 70A which are fixed to the belts 60, 62. Accordingly, when the belts 60, 62 are moved, the holding mechanisms 64, 66 move up or down.

The holding members 76, 78 are supported on the sliding blocks 68, 70 by means of rod members. In more detail, the holding members 76, 78 are mounted to the sliding blocks 68, 70 through springs 72, 74 arranged around the respective rod members such that a constant biasing force is applied in the grasping direction by the springs 72, 74. Namely, the springs 72, 74 provide a grasping force at the time the container body 12 is grasped and held on both sides thereof by the pair of holding members 76, 78. Of course, in this case, the container body 12 is clamped by operating the horizontal driving portion 32 to move the two stages 30R, 30L toward each other. In this connection, such clamping of the container body 12 is carried out in the state where the holding mechanisms 64, 66 are positioned at a low position, and then after the clamping is carried out, the vertical driving portion 34 is operated to raise the pair of holding mechanisms 64, 66 holding (grasping) the container body 12 upward.

In accordance with the structure shown in FIG. 3, because the stages 30R, 30L can be moved in opposite directions within a predetermined range, it is possible to reliably grasp and hold the container body 12 to a certain degree even for a wide variety of container body diameters. In this connection, the height where such grasping and holding is carried out is preferably set at a predetermined height which is determined using the top surface of the rack 10 as a reference level.

In the structure shown in FIG. 3, a light emitting element 86 and a light receiving element 84 which form the second sensor 83 shown in FIG. 2 are provided in a fixed state at a prescribed height on both sides of the raising/lowering path of the container body 12. In the example structure shown in FIG. 3, the light emitting element 86 and the light receiving element 84 are respectively mounted on the stages 30R, 30L via arms 80, 82, but the present invention is not limited to this structure. An optical beam 203 is run between the light emitting element 86 and the light receiving element 84, and when the container body 12 held by the pair of holding members 64, 66 is raised upward, a cap 13 provided in the top portion of the container body 12 intersects the optical beam 203. Accordingly, because the output signal level in the light receiving element 84 changes, this makes it possible to detect the presence of the cap 13, namely, the height of the top surface of the cap 13 which forms the reference surface. This detection will be described in detail later with reference to FIG. 4 and FIG. 5.

Further, as shown in FIG. 1, the first sensor 18 mounted underneath the rotary plate 20 is positioned above the container body 12 of which cap is to be opened, and the detection of an object is carried out within a predetermined range along the axis of an optical beam 204 created by the first sensor 18. In this way, by creating the two orthogonal optical beams 203, 204, in the case where for example the cap 13 is not provided in the container body 12, it is possible to avoid the case where the upper edge of the container body 12 is mistakenly recognized as the top surface of the cap 13. Of course, it is possible to use various other structures as a sensor for detecting the presence or absence of a cap, or as a sensor for detecting the top surface of the cap.

Figure 4:
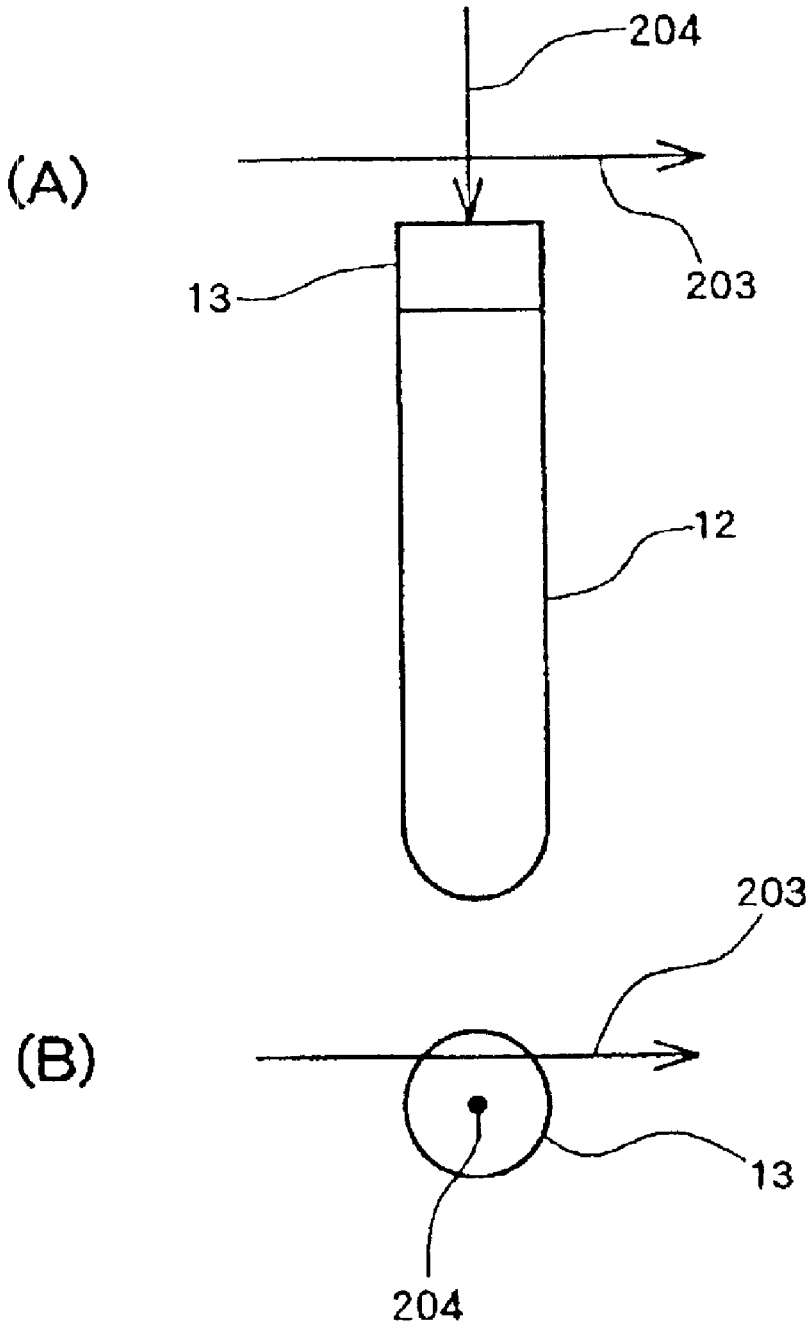
FIGS. 4(A) and (B) are illustrations for explaining the function of two optical beams.

The optical beams 203, 204 described above are shown in FIG. 4 and FIG. 5, in which (A) is a view taken in the horizontal direction, and (B) is a view taken from above. In FIG. 4, the top surface of the cap 13 provided in the container body 12 is flat. As shown in FIG. 4, the optical beam 203 is set to pass through a position shifted slightly from the center portion of the top surface of the cap 13 in the horizontal direction, and the optical beam 204 is set in the center of the cap 13. When the container body 12 is raised upward, the optical beam 203 is interrupted by the cap 13, and detection of the top surface level of the cap 13 is made at this timing. At that time, if an object is detected by the optical beam 204, it is possible to confirm the presence of the cap 13. On the other hand, in the case where an object is not detected at that time, it is judged that the cap 13 is not provided in the container body 12 and there is a possibility that the upper edge of the container body 12 has interrupted the optical beam 203, thus an error process is carried out in such case.

Figure 5:
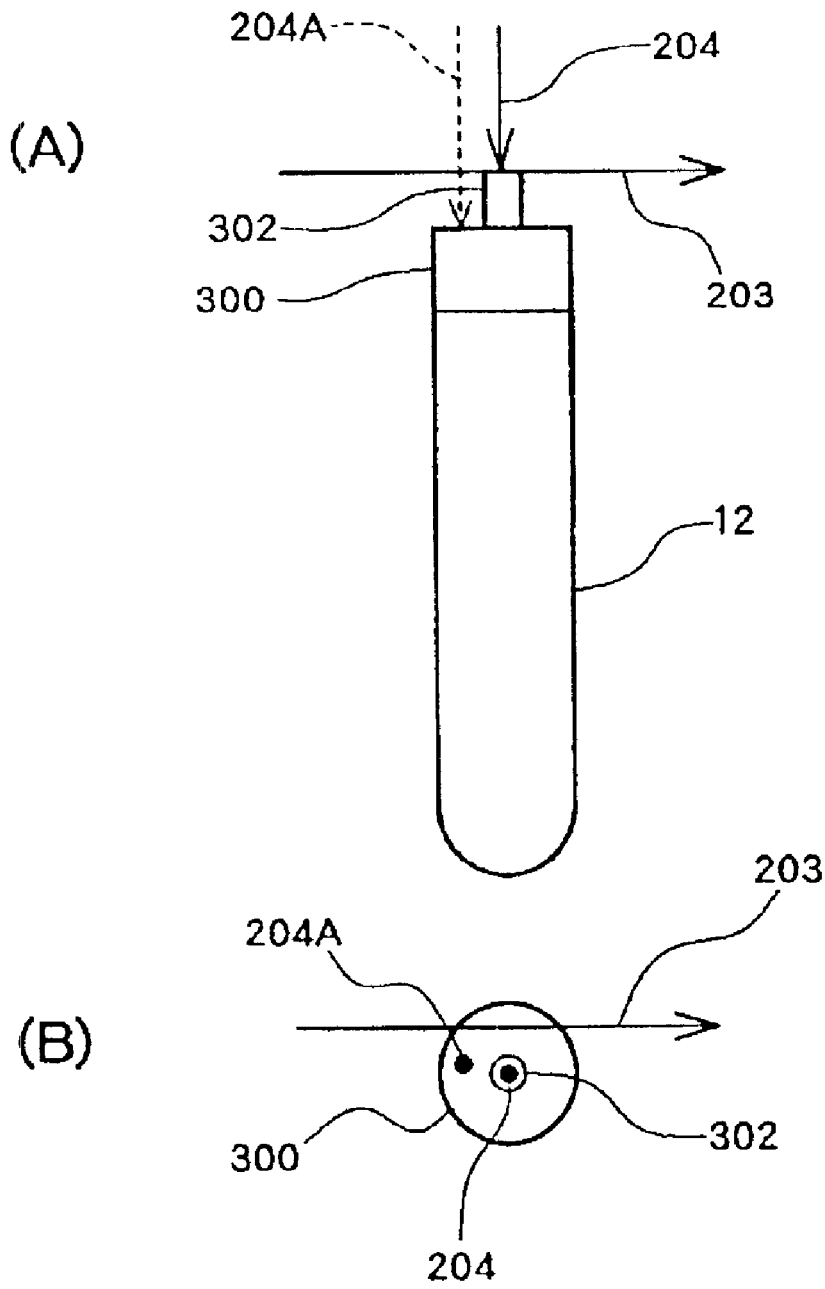
FIGS. 5(A) and (B) are illustrations for explaining the function of the two optical beams.

As shown in FIG. 5, there is a case that the center portion of a cap 300 is provided with a protruding portion 302 which protrudes upward. Even in such a case, according to the present embodiment, since the optical beam 203 is set to pass through a position shifted slightly from the center portion of the top surface of the cap 300 in the horizontal direction as shown in FIG. 5(B), it is possible to accurately detect the top surface of the cap 300 without being affected by the protruding portion 302. In this case, in the same way as for the structure shown in FIG. 4, the optical beam 204 may be set in the center of the cap 300, but in order to more accurately judge the presence or absence of a cap, the position of the optical beam 204 may be shifted slightly, namely, as shown by the reference numeral 204A in FIG. 5(B), the optical beam 204 may be set at a position shifted slightly from the center portion of the cap 300.

In either of the cases described above, it is possible to detect the height of the top surface of the cap 13 individually for each cap, and the position of the cap is determined based on the height of the top surface which is used as a reference level. Therefore, even when the length of the container body 12 and the thickness of the cap 13 vary to a certain extent as described above, such variation can be allowed, and a reliable cap opening operation can be carried out.

Next, an example of the specific structure of the cap opening head 16 shown in FIG. 1 will be described with reference to FIG. 6.

The cap opening head 16 functions as the cap handling apparatus as described above, and the cap opening head 16 is mounted underneath the rotary plate 20.

An outer frame 100 is formed into a casing having a hollow cylindrical shape, and an internal unit 102 is rotatably housed inside the outer frame 10. Namely, the internal unit 102 is held by the outer frame 10 through a bearing mechanism 101 in a freely rotatable manner. The internal unit 102 functions as a rotary unit.

In the internal unit 102, an inner frame 108 having a hollow cylindrical shape forms the frame of the internal unit 102, and a rotation shaft 110 is provided on the center axis of the inner frame 108. An upper end 110B of the rotation shaft 110 is the driving end, and a pulley 113 is coupled to the upper end 110B. A belt 115 is wrapped around the pulley 113, and rotational force of a single drive motor not shown in the drawing is transmitted to the rotation shaft 110 via the belt 115 and the pulley 113. A bearing 108C is provided in a lower portion of the inner frame 108. Further, the bearing 108C holds a lower end 110C of the rotation shaft 110 to enable advancement and retraction, namely, to enable up and down movement in a freely rotatable manner. The rotation shaft 110 is also formed with a screw portion 110A in the form of a trapezoidal screw thread, and a nut member 112 which functions as a cam member is threaded onto the screw portion 110A in a rotation restricted state with respect to the inner frame 108. In the state where advancing and retracting movement, namely, up and down movement of the nut member 112 is allowed, when the rotation shaft 110 undergoes a forward (positive) rotation, the nut member 112 moves in the advancing direction, namely, in the downward direction. On the other hand, when the rotation shaft 110 undergoes reverse rotation, the nut member 112 moves in the retracting direction, namely, in the upward direction. In this connection, an opening 108A is formed in the upper portion of the inner frame 108, and the rotation shaft 110 is inserted through the opening 108A.

Figure 6:
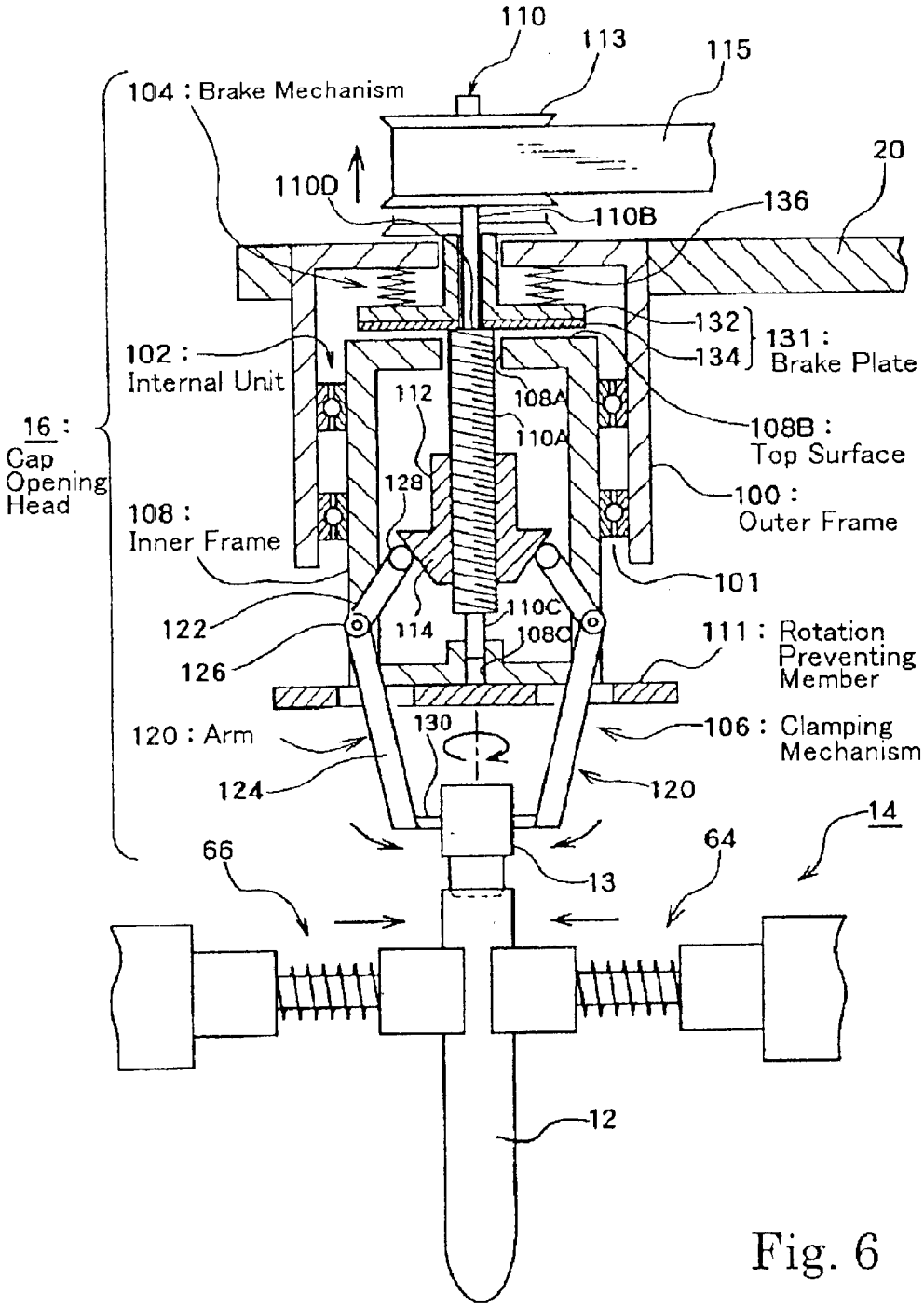
FIG. 6 is a cross sectional view which shows the structure of a cap handling apparatus of the cap opening system.

As shown in FIG. 6, an inclined surface 114 is formed on the nut member 112. The inclined surface 114 functions so as to open and close a plurality of arms 120 described below.

In this connection, in FIG. 6, the nut member 112 is provided so as to be raised or lowered freely with respect to the inner frame 108, but there is a restriction on its rotation (in other words, the nut member 112 is constructed so that when the internal unit 102 is rotated, the nut member 112 is also rotated therewith). As a means for achieving such restriction, a pin (not shown in the drawing) can be provided on the nut member 112, and a groove (not shown in the drawing) to which the pin is movably engaged can be formed in the inner frame 108 in the up and down direction. Namely, by engaging the pin into the groove, the pin is allowed to move up and down, and the rotation of the nut member 112 is transmitted to the inner frame 108 via the pin. As another means, the nut member 112 can be formed to have a pyramid shape, and by the abutment between each inclined surface 114 and each driving end 128, the nut member 112 can be rotated together with the inner frame 108 while the nut member 112 is being allowed to move up and down.

In the embodiment shown in FIG. 6, an example having two arms 120 is shown. Of course, it is also possible to provide three or more arms 120.

Each arm 120 is formed into a roughly V-shape as shown in FIG. 6, and the bent portion thereof forms a rotation axis 126. The portion above the rotation axis 126 is a first portion 122, and the portion below the rotation axis 126 is a second portion 124. The arm 120 pivots about the rotation axis 126. The tip end of the first portion 122 forms a driving end 128 which abuts the inclined surface 114. When the nut member 112 is advanced and retracted, the driving ends 128 slide on the inclined surface 114 in accordance with such movement. Then, in accordance with such sliding movement, the driving ends 128 move away from each other or toward each other, whereby the second portions 124 of the arms 120 are moved to be opened or closed. A claw 130 is formed on the bottom end (operating end) of each arm 120, and when the arms 120 are moved to be closed, the side surface of the cap 13 is held (grasped) between each claw 130, namely, the cap 13 is clamped. Namely, such plurality of arms 120 constitutes a clamping mechanism 106.

In this connection, a weak biasing force which is normally exerted in the grip release direction can be applied to each arm 120 by a release spring or the like. This kind of spring may be provided between the inclined surface 114 and the driving end 128, or on the rotation shaft 126. In addition to these arrangements, it is possible to adopt various other structures As shown in FIG. 6, a brake mechanism 104 is provided in the upper portion inside the outer frame 100. In the present embodiment, the brake plate 104 is constructed from a brake plate 131 and a plurality of springs 136. The plurality of springs 136 constitute a means for biasing the brake plate 131 normally in the downward direction. In this embodiment, the brake plate 131 is constructed from a base member 132 and a brake shoe member 134 provided on the surface of the base member 132. A through hole is formed in the center portion of the base member 132, and the upper end 110B of the rotation shaft 110 is inserted through the through hole to enable free rotation. FIG. 6 shows the state in which the cap 13 is grasped by the clamping mechanism 106, the rotation shaft 110 is moved in the retracting direction, namely, raised upward, and the brake plate 131 is pushed upward by a shoulder portion 110D formed on the rotation shaft 110. However, other than such grasped state, the brake plate 131 is pushed to abut a top surface 108B of the inner frame 108, namely, the rotation of the internal unit 102 is restricted by the brake plate 131. Specifically, in the initial state, the nut member 112 is at a retracted position, and the rotation shaft 110 is in a state where it is pushed in the advancing direction, namely, downward by the force of the springs 136, and the internal unit 102 is in a state where the rotation thereof is restricted by the brake mechanism 104. From this state, when the rotation shaft 110 is rotated forward, the nut member 112 begins to move in an advancing direction relative to the rotation shaft 110, namely, move downward by the threading engagement between the screw portion 110A and the nut member 112, and in accordance with this movement, the driving ends 128 of the arms 120 are moved upward along the inclined surfaces 114. Namely, the driving ends 128 are moved away from each other. When this happens, the operating ends (i.e., the claws 130) are moved toward each other, whereby the side surface of the cap 13 is grasped. Then, when the grasping force reaches a predetermined value, namely, when the grasping force exceeds the total force of the plurality of springs 136, the advancing movement of the nut member 112 is stopped, and at the same time, the forward rotation movement of the rotation shaft 110 is converted to retracting movement of itself. Namely, the rotation shaft 110 begins to move upward, and in accordance with this movement, the brake plate 131 is raised slightly upward by the shoulder portion 110D, and at this time, the rotation of the internal unit 102 is allowed. Namely, the forward rotational movement of the rotation shaft 110 is transmitted to the internal unit 102 as it is as forward (positive) rotary movement of the internal unit 102. In this state, the internal unit 102 rotates together with the rotation shaft 110, and in the same way, the cap 13 held by the clamping mechanism 106 is also rotated.

As described above, in accordance with the structure shown in FIG. 6, it is possible to automatically apply a predetermined grasping force to the cap 13 merely by transmitting rotational force to the rotation shaft 110, and it is also possible to automatically rotate the cap 13 from the point in time where such predetermined grasping force is obtained. In particular, because it is possible to apply a predetermined grasping force irrespective of the diameter of the cap 13, a reliable clamping can be carried out, and the operation timing (conditions) of the rotary movements can be set appropriately so as to suit such diameters. In this connection, the adjustment of the grasping force by the clamping mechanism 106 can be changed easily by adjusting the biasing force of the plurality of springs 136. Further, with regards to these operations, the action of the weak springs biasing the arms 120 can be practically ignored.

Further, as will be described later, an operation in which the container body grasping unit 14 lowers the container body 12 downward by a predetermined distance is carried out together with the operation of the cap opening head 16, whereby the removal of the cap 13 from the container body 12 can be carried out together with the rotary movement of the cap 13 described above.

Further, according to the structure described above, the cap opening system can be applied to not only so-called push-in caps but also screw caps.

Next, the operation for disposing of the cap 13 will be described. Abutment members (not shown in the drawings) are provided above the disposal box 24 shown in FIG. 1, and when the cap 13 is to be discarded, the side surface of a rotation preventing (stopping) member 111 provided on the bottom of the inner frame 108 shown in FIG. 6 abuts the plurality of abutment members, and this abutment prevents rotation of the rotation preventing member 111. Accordingly, when the rotation shaft 110 is rotated in reverse in this state, the nut member 112 moves in the retracting direction by the threading engagement between the screw portion 110A and the nut member 112, whereby the rotation shaft 110 itself is moved in the advancing direction and returned to its original position. Then, the plurality of arms 120 are opened by the retracting movement of the nut member 112, whereby the cap 13 is released from the claws 130 and falls downward, namely, falls into the inside of the disposal box 24 shown in FIG. 1.

Figure 7:
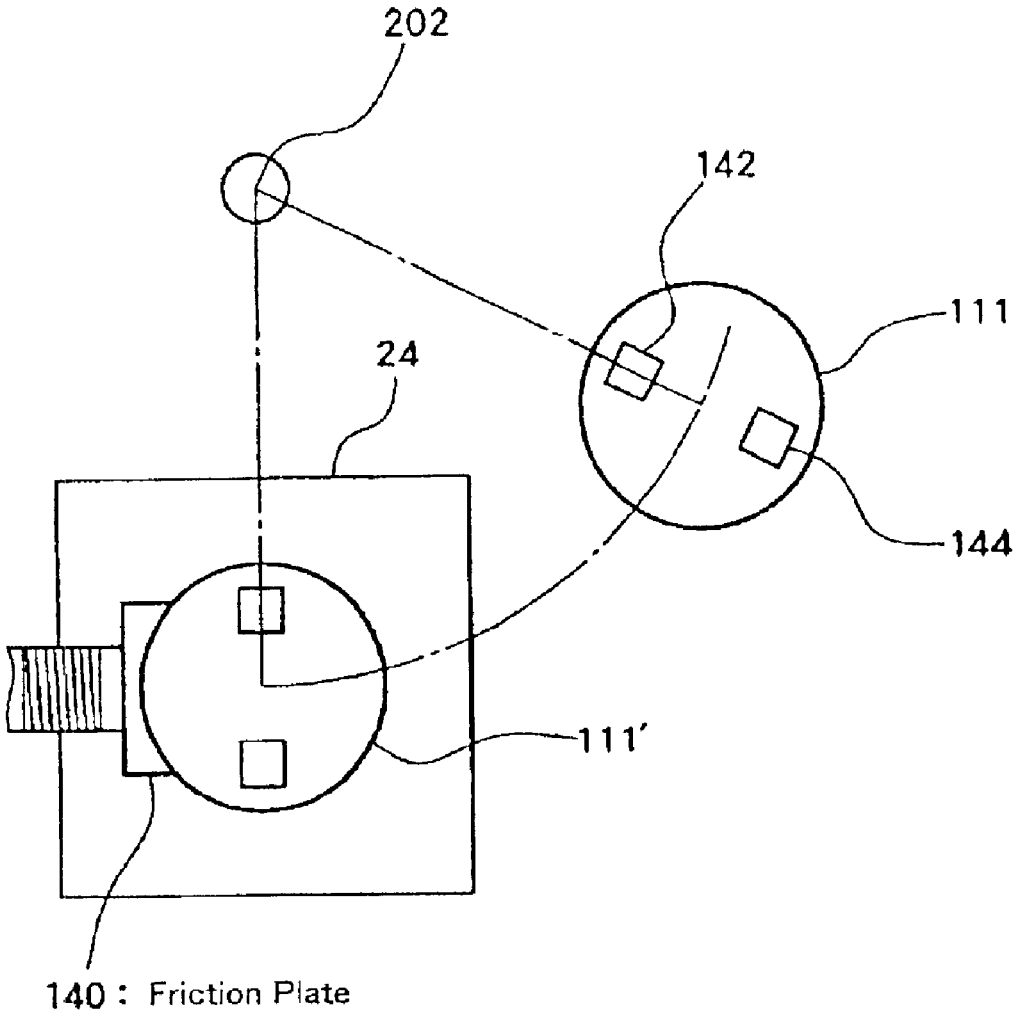
FIG. 7 is an illustration for explaining the operation of a rotation preventing member when disposing of the cap.
Figure 8:
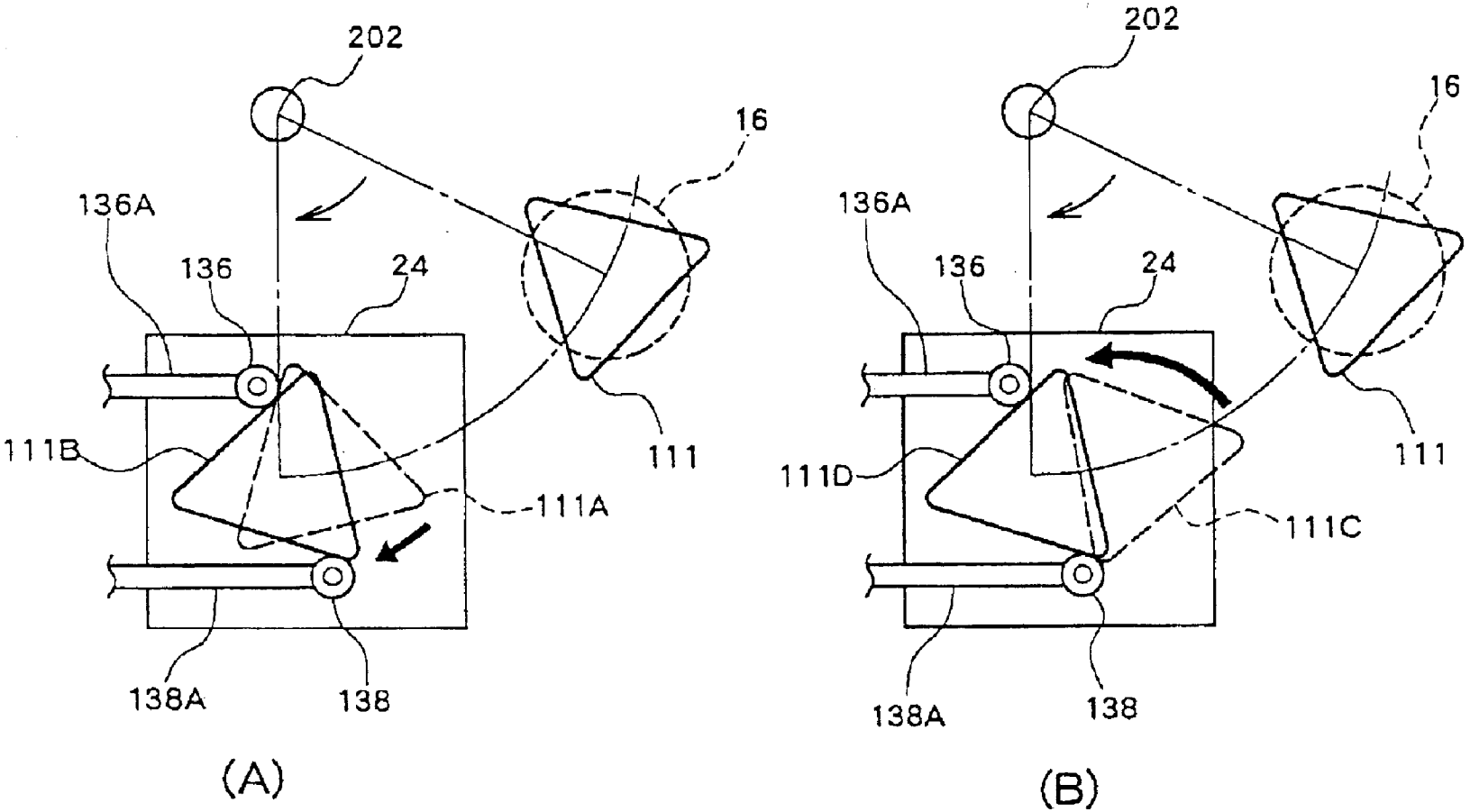
FIGS. 8(A) and (B) are illustrations for explaining the operation of the rotation preventing member when disposing of the cap.

FIG. 7 and FIG. 8 show several examples related to the rotation preventing member 111. In the example shown in FIG. 7, the rotation preventing member 111 is formed into a circular plate. The rotation preventing member has for example openings 142, 144 through which two arms are passed. In the state where the cap opening head 16 is positioned above the disposal box 24, the rotation preventing member 111 abuts a friction plate 140 as shown by the reference character 111', thereby restricting rotation of the rotation preventing member 111, namely, rotation of the internal unit 102 shown in FIG. 6.

In the example structure shown in FIG. 8, the rotation preventing member 111 is formed into a triangular plate. This kind of triangular plate is preferred in the case where the clamping mechanism 106 includes three arms, and it is possible to arrange each arm near the center portion of each side of the triangular plate.

As shown by the two operation examples in FIG. 8(A) and FIG. 8(B), two rotation rollers 136, 138 supported by two arms 136A, 138A are provided above the disposal box 24. The distance between these two rotation rollers 136, 138 is set to be slightly shorter than the length of one side of the triangular plate. Accordingly, as shown in FIG. 8(A), when the cap opening head 16 is rotated about the rotation axis 202 and positioned above the disposal box 24, the rotation preventing member 111 rotates in accordance with the rotation angle of the rotation preventing member 111, and this rotation is finally prevented by the abutment with the two rotation rollers 136, 138. This is shown in FIG. 8(A) by the reference characters 111A, 111B. In the same way, as shown in FIG. 8(B), even in the case where the rotation preventing member 111 is at a different rotation angle, when a peak portion of the rotation preventing member 111 abuts one of the rotation rollers 136, 138 as shown by the reference character 111C, the rotation preventing member 111 is automatically rotated so that the triangular rotation preventing member 111 falls in between the two rotation rollers 136, 138, and in this state the rotation thereof is prevented. Accordingly, in this state where such rotation is prevented, if the rotation shaft 110 shown in FIG. 6 is rotated in reverse, it becomes possible to open the arms 120 and smoothly release the cap 13, and it also becomes possible to return the rotation shaft 110 and the nut member 112 to their original positions.

Next, the operation of the cap opening system according to the present embodiment will be described with reference to FIG. 9.

First, at Step S101, the rack 10 is positioned so that the container body 12 having a cap to be opened is set at the cap opening position as shown in FIG. 1. At Step S102, the container body 12 is grasped and held by the container body grasping unit 14. Then, at Step S103, the held container body 12 is raised upward by the container body grasping unit 14.

At Step S104, a judgment of whether or not the top surface of the cap has been detected, namely, whether or not the optical beam 203 has been interrupted during the raising step is carried out by the second sensor (i.e., the light emitting element 86 and the light receiving element 84) shown in FIG. 3. In the case where the output signal of the second sensor is ON, namely, in the case where the top surface of the cap is detected, the raising of the container body 12 by the container body grasping unit 14 is stopped at Step S105. This stopping position is then utilized as the origin height.

At Step S106, an object detection is carried out from above the container body 12 by the first sensor 18 shown in FIG. 1, and in the case where the presence of the cap 13 can not be confirmed, the error process at Step S107 is carried out. On the other hand, in the case where the presence of the cap 13 can be confirmed, then at Step S108, the rotary plate 20 is rotated 90 degrees counterclockwise, whereby the cap opening head 16 is positioned above the cap opening position 200 as shown in FIG. 1.

Then, at Step S109, the container body 12 at the origin height is raised by a predetermined distance (e.g., 2 cm) upward, whereby the height of the cap is positioned properly with respect to the cap opening head 16.

At Step S110, a cap opening operation is carried out by the cap opening head 16. In this case, during such cap opening operation being carried out, the container body 12 is lowered by a predetermined distance downward by the container body grasping unit 14. Then, the container body 12 is finally lowered to the same height as the stopping position in Step S105.

At Step S111, the output signal of the second sensor is monitored. In the case where the output signal of the second sensor is ON, namely, in the case where the optical beam is interrupted, because there is a possibility that the cap opening operation was not carried out properly, the process proceeds to Step S107.

On the other hand, in the case where the cap opening operation is judged to have been carried out properly at Step S111, then at Step S112, the rotary plate 20 shown in FIG. 1 is rotated 90 degrees clockwise, whereby the first sensor 18 is positioned above the cap opening position 200, and at the same time, the cap opening head 16 holding the removed cap is positioned above the disposal box 24. Then, in this state, the held cap is released and falls into the inside of the disposal box 24 as shown by Step S113. At the same time, at Step S114, an object detection is carried out by the first sensor 18, namely, confirmation of whether or not the cap opening operation has been performed properly is carried out again. In this regard, in the case where an object is detected by the first sensor, the cap opening operation is judged to have not been carried out properly, and the process proceeds to Step S107.

On the other hand, in the case where the cap opening operation is judged to have been carried out properly at Step S114, the container body grasping unit 14 returns and conveys the opened container body 12 downward to the rack 10. Then, at Step S116, in the case where this process is to be continued, each step from Step S101 is repeatedly carried out.

Figure 9:
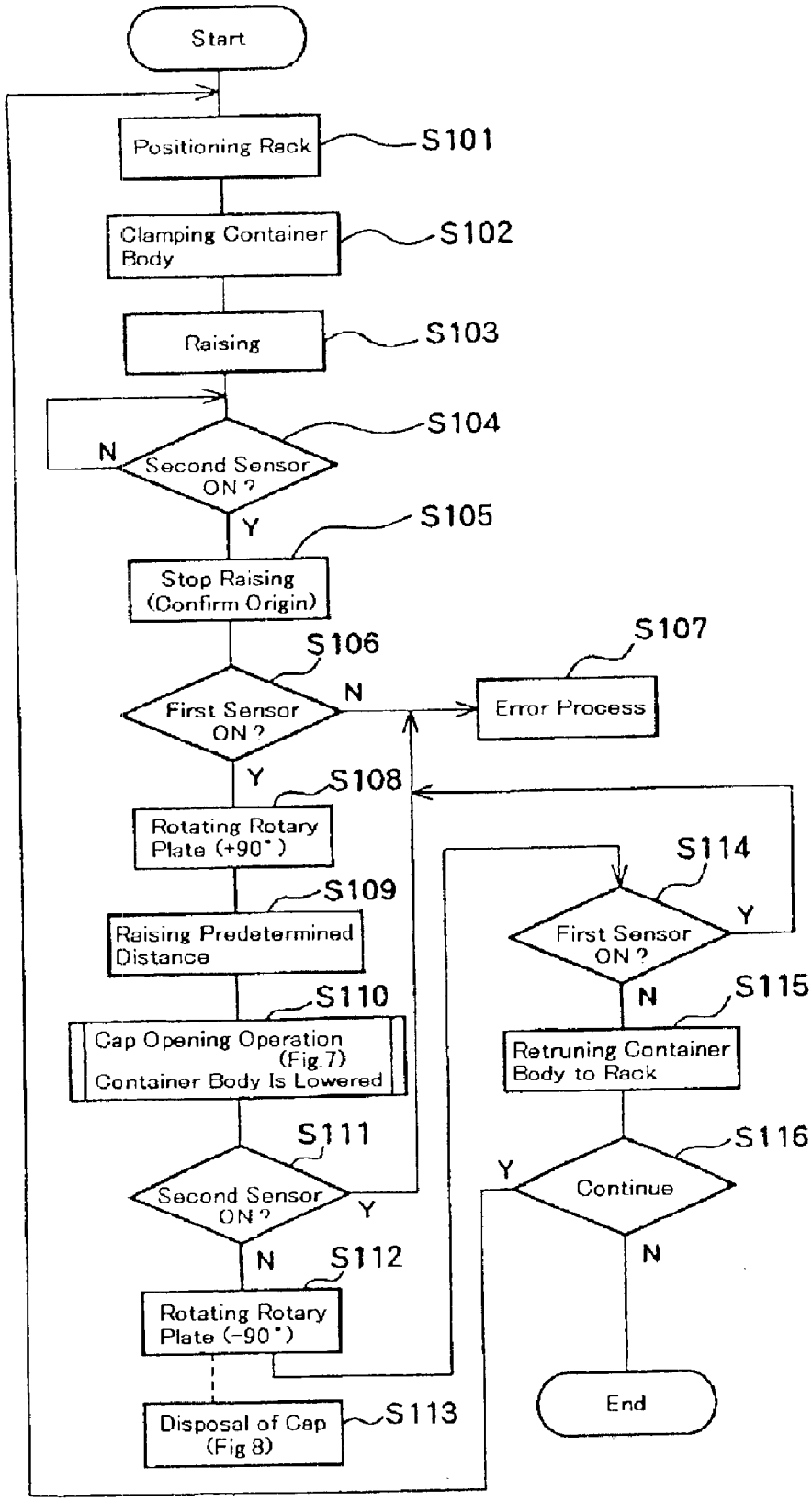
FIG. 9 is a flow chart for explaining the operation of the cap opening system according to the present invention.
Figure 10:
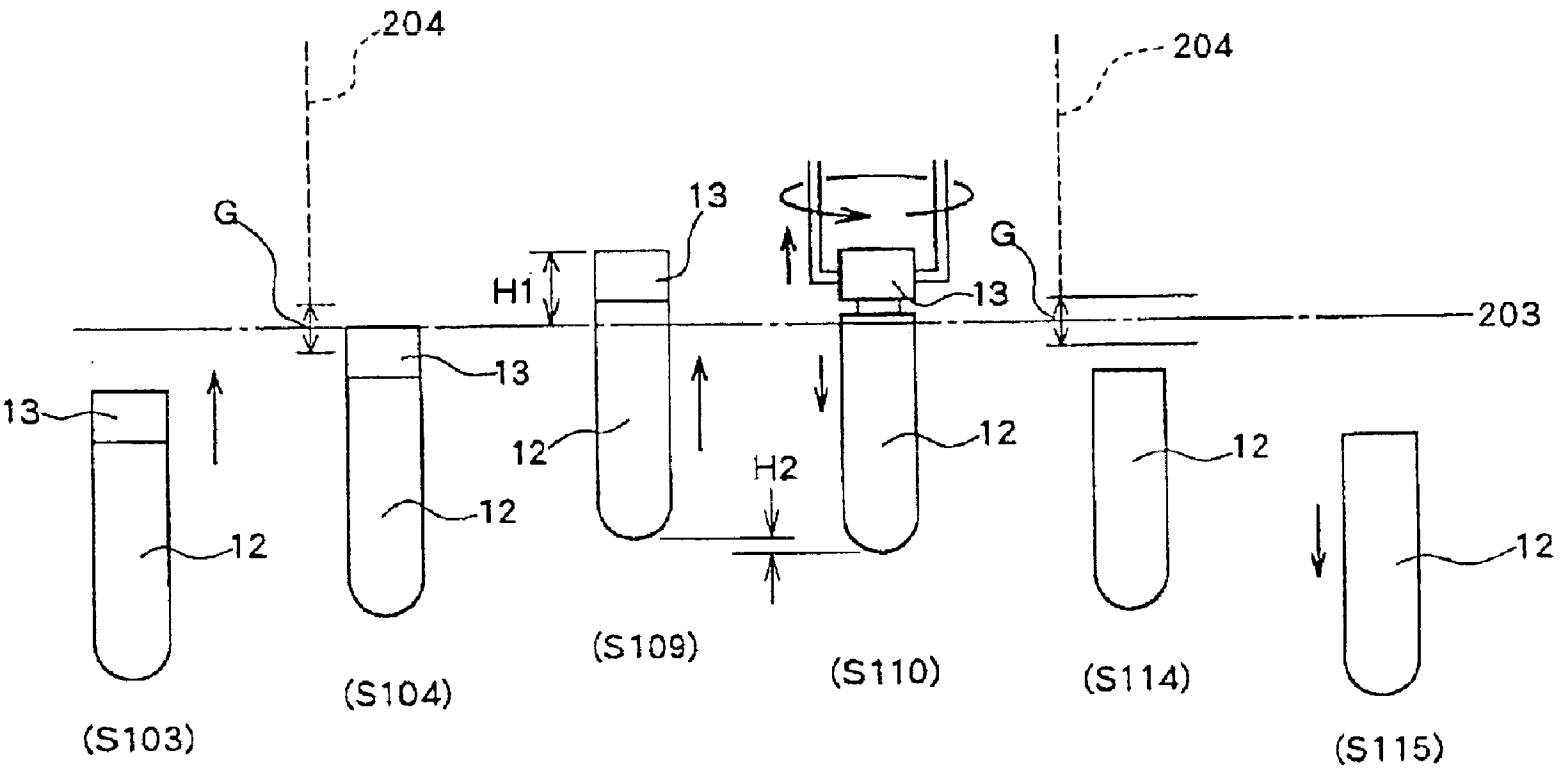
FIG. 10 is an illustration for explaining the main operations in the flow chart shown in FIG. 9.

FIG. 10 shows the main operations in the process represented by the flow chart of FIG. 9*a*. As described above, the container body 12 is raised upward at Step S103, and this raising of the container body 12 is stopped when the top surface of the cap 13 is detected at Step S114. In this state, an object detection is carried out by the optical beam 204 at Step S106, and in this case, for example, an object detection is carried out within a predetermined range G with the optical beam 203 as a reference level.

At Step S109, the container body 12 is raised by a predetermined distance H1 upward, and the cap 13 is positioned properly with respect to the cap opening head 16.

At Step S110, the container body 12 is lowered by a predetermined distance H2 downward while the cap which has been grasped by the cap opening head is being rotated.

At Step S114, after the cap opening operation is carried out, the container body 12 is positioned at the same height as the height in Step S104, and in this state, the optical beam 204 is utilized to carry out object detection. In this case, when an object is not present within a predetermined range G, the cap opening operation is judged to have been carried out properly. At Step S115, the opened container body 12 is lowered downward and returned to the rack.

Of course, the process (operation) shown in FIG. 9 and FIG. 10 is only one example, and it is possible to adopt various other processes (operations).

Figure 11:
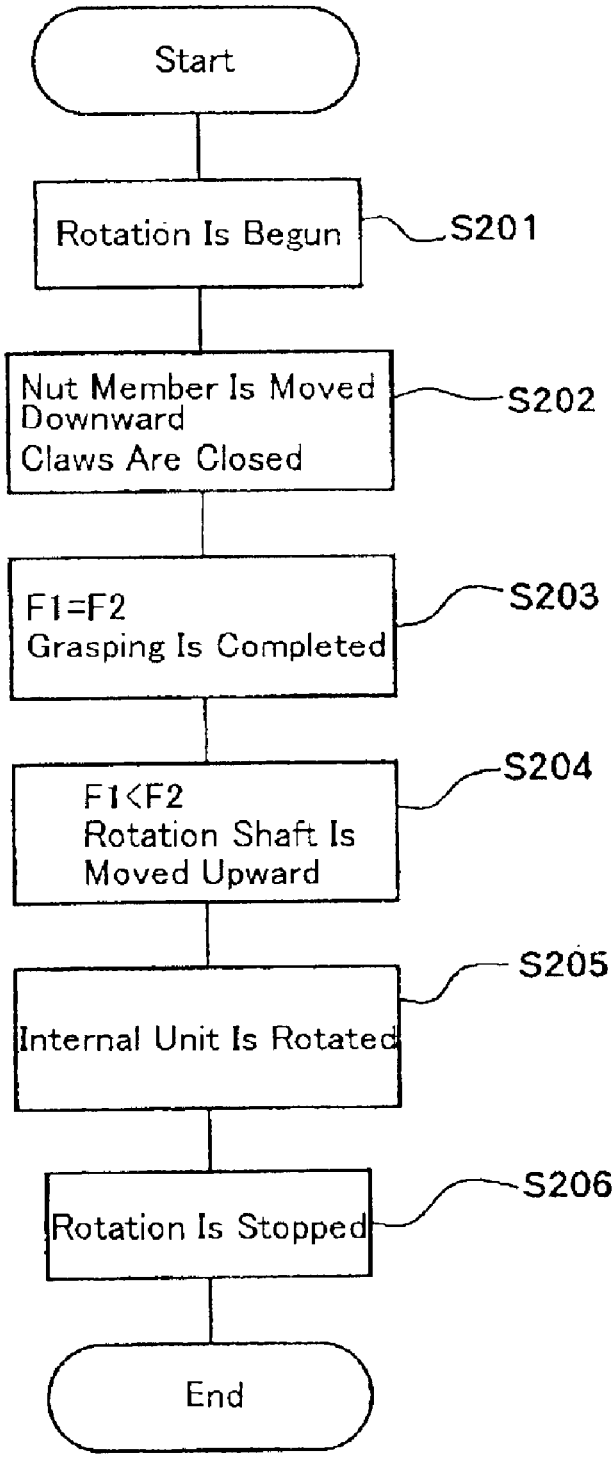
FIG. 11 is a flow chart for explaining the operation of the cap handling apparatus when opening a cap.
Figure 12:
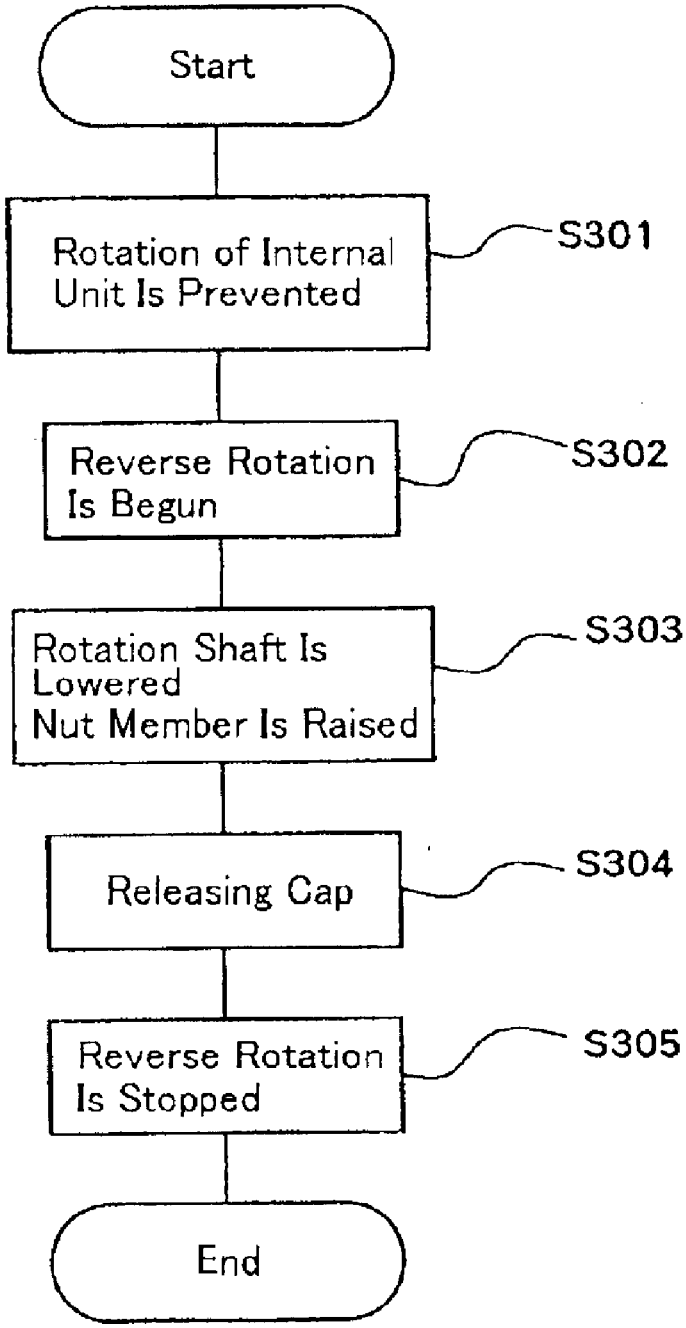
FIG. 12 is a flow chart for explaining the operation of the cap handling apparatus when disposing of a cap.

FIG. 11 shows a flowchart of the operations of the cap opening head at Step S110 in FIG. 9, and FIG. 12 shows a flowchart of the operations of the cap opening head at the time the cap is discarded at Step S113 in FIG. 9.

In FIG. 11, at Step S201, rotation of the rotation shaft 110 is begun in the cap opening head 16 shown in FIG. 6. In this way, as shown by Step S202, the nut member 112 begins to move in the advancing direction, and in accordance with this movement, the clamping mechanism 106 carries out a grasping movement. Namely, the claws 130 are moved toward each other. Then, when the grasping of the cap 13 is completed, namely, when the advancing movement of the nut member 112 is stopped, the biasing force F1 exerted by the plurality of springs 136 is balanced with the upward force F2 exerted on the nut member 112 by the driving ends 128 as shown in Step S203. In this state, when rotation of the rotation shaft 110 is further continued, F2 becomes larger than F1 as shown in Step S204, whereby the shoulder portion 110D of the rotation shaft 110 pushes the brake plate 131 upward. Then, as shown by Step S205, when the rotation restricted state of the internal unit 102 is released, the internal unit 102 is allowed to do rotary movement in accordance with the rotation of the rotation shaft 110. Then, after a predetermined number of rotations is carried out, the operation of the driving motor is stopped, whereby the rotation of the internal unit 102 is also stopped as shown in Step S206.

Next, as shown in FIG. 12, when the cap is to be discarded, the cap opening head 16 is positioned above the disposal box 24, and in this state, as was described above with reference to FIG. 7 and FIG. 8, the rotation of the rotation preventing member 111 is prevented. Namely, the rotation of the internal unit 102 is prevented.

At Step S302 in FIG. 12, rotational force in the reverse direction is transmitted to the rotation shaft by the driving motor, and then as shown in Step S303, the rotation shaft 110 is returned to its original position, and in accordance with this, the nut member 112 is retracted backward and returned to its original position. Then, during this process, as shown by Step S304, the cap being held up to now is released from the clamping mechanism 106 and falls into the inside of the disposal box 24. After that, the reverse rotation operation of the driving motor is stopped as shown in Step S305.

Hereinbelow, a description will be made with regard to another embodiment of the cap opening system which is believed to be more practical.

When contrasting the cap opening system of this embodiment with the structure of the first embodiment shown in FIG. 1 to FIG. 8, there are differences in their cap positioning means and the structures of the stages of the container body grasping units. Therefore, the same reference numerals are assigned to the same structures and components as those shown in FIG. 1 to FIG. 8, and explanation thereof are omitted.

Figure 13:
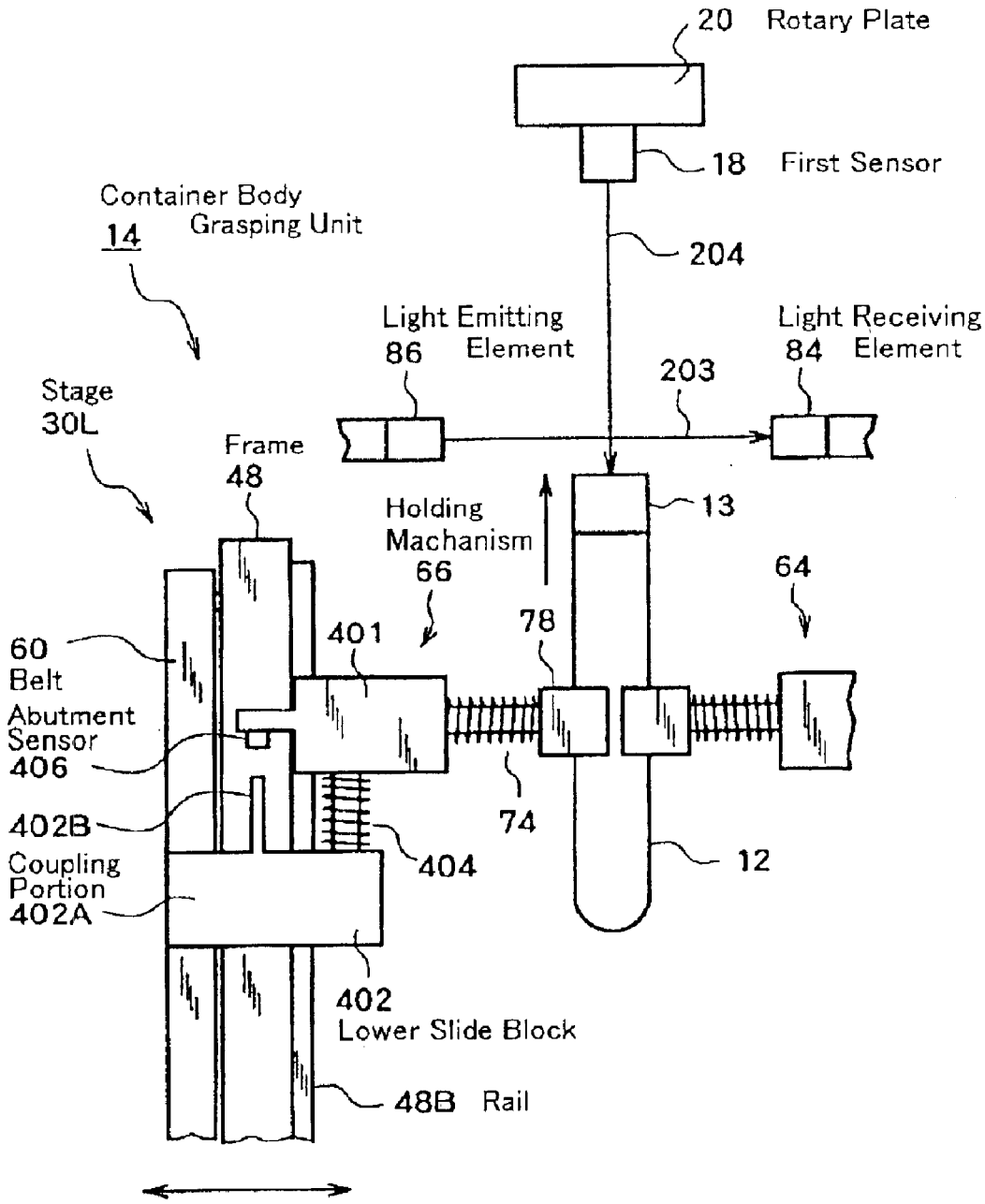
FIG. 13 is an illustration which schematically shows the structure of a container body handling apparatus according to another embodiment of the present invention.

FIG. 13 shows the structure of a part of the container body grasping unit 14 (in particular, the structure which is different from the embodiment shown in FIG. 3). Although the container body grasping unit 14 has two stages, only one stage 30L is shown in FIG. 13. The other stage has the same structure as that of the stage 30L.

The stage 30L includes an erected frame 48 having a rail 48B. An upper slide block 401 and a lower slide block 402 are slidably mounted to the rail 48B. A spring 404 which is a compression spring is provided between the upper slide block 401 and the lower slide block 402 so that the upper slide block 401 is biased upward with respect to the lower slide block 402 to the extent of a certain distance. The lower slide block 402 is formed with a coupling portion 402A, and the lower side block 402 is coupled to a belt 60 by means of the coupling portion 402A. Namely, the lower slide block 402 is a slide block of a driving side, and the upper slide block 401 is a slide block of a driven side, and they are normally moved up and down together.

As shown in FIG. 13, the upper slide block 401 is provided with an abutment sensor 406. As described later, positioning of the cap 13 (formation of abutment state) is carried out before opening the cap. In this case, when the upward movement of the upper slide block 401 is forcedly stopped, a contact 402B formed on the lower slide block 402 contacts with the abutment sensor 406 due to the upward movement of the lower slide block 402. Then, a control section not shown in the drawings recognizes the abutment of the cap based on an output signal from the abutment sensor 406, and at the same time, stops the driving of the belt 60. By such abutment state and the control for the raising movement, the cap 13 can be properly positioned with respect to the cap opening head.

FIG. 13 shows the state that the first sensor 18 is at the rotational position B shown in FIG. 1. As was described above, on the opposite sides of the raising and lowering path of the container body 12 (that is, the cap 13), the light emitting element 86 and the light receiving element 84 which constitute the second sensor are provided at a predetermined height. This second sensor forms the optical beam 203. During the process that the container body 12 is being raised, when the cap 13 reaches the optical beam 203, the optical beams 203 is interrupted by the cap 13, and the reference surface (that is, the top surface of the cap or the top surface of the protruding portion) of the cap 13 is detected by the interruption of the beam. In this embodiment, the raising movement of the container body 12 is stopped at that time, and in this stopped state, detection for the presence or absence of an object is carried out by the first sensor 18. The first sensor 18 forms a vertical optical beam aligned with the center of the cap 13 to detect the presence or absence of an object within a predetermined height range along the optical beam 204 with using the height of the optical beam 203 as a reference level. In this case, if the cap 13 exists, the cap 13 is detected by the reflection of the beam. On the other hand, if there is no cap 13, that is if the cap 13 is not provided in the container body 12, no object is detected. In this way, it is possible to confirm the presence of the cap before the cap opening operation, thereby enabling to perform the cap opening operation with high reliability. This advantage is the same as the first embodiment shown in FIG. 1 to FIG. 8.

Figure 14:
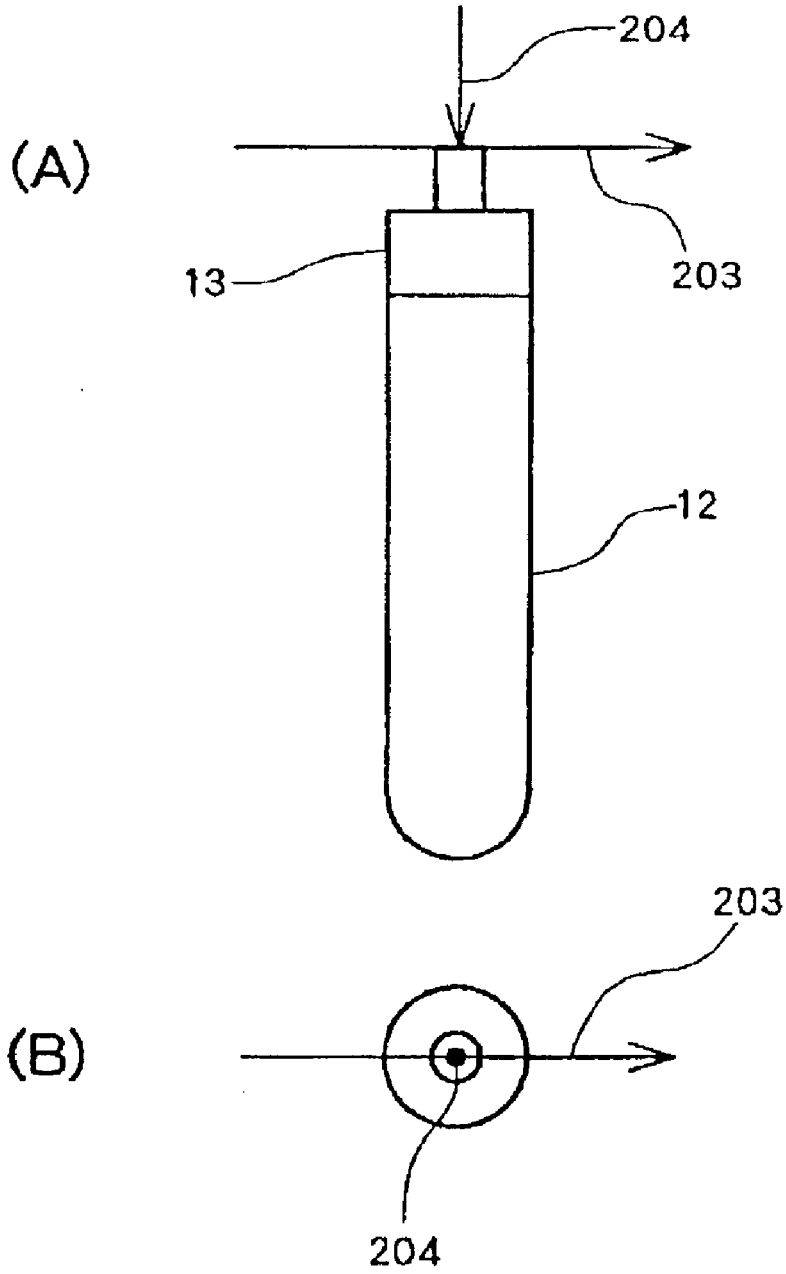
FIGS. 14(A) and (B) are illustrations which show the relation between two optical beams according to the another embodiment of the present invention.

FIG. 14 shows the relation between the optical beam 203 and the optical beam 204. The optical beam 203 is set so as to pass through the center of the cap 13, and the optical beam 204 is also set so as to align with the center of the cap 13. Therefore, in the case of the cap 13 having the protruding portion as shown in FIG. 14, the top surface of the protruding portion is detected with the respective optical beams 203 and 204. In this embodiment, only detection of the presence or absence of the cap is needed, and the positioning of the cap 13 with respect to the cap opening head is carried out by a separate means. Therefore, there is no problem even if the optical beams 203 and 204 as shown in FIG. 14 are used. Of course, it goes without saying that the technique as shown in FIGS. 4 and 5 may be adopted.

Figure 15:
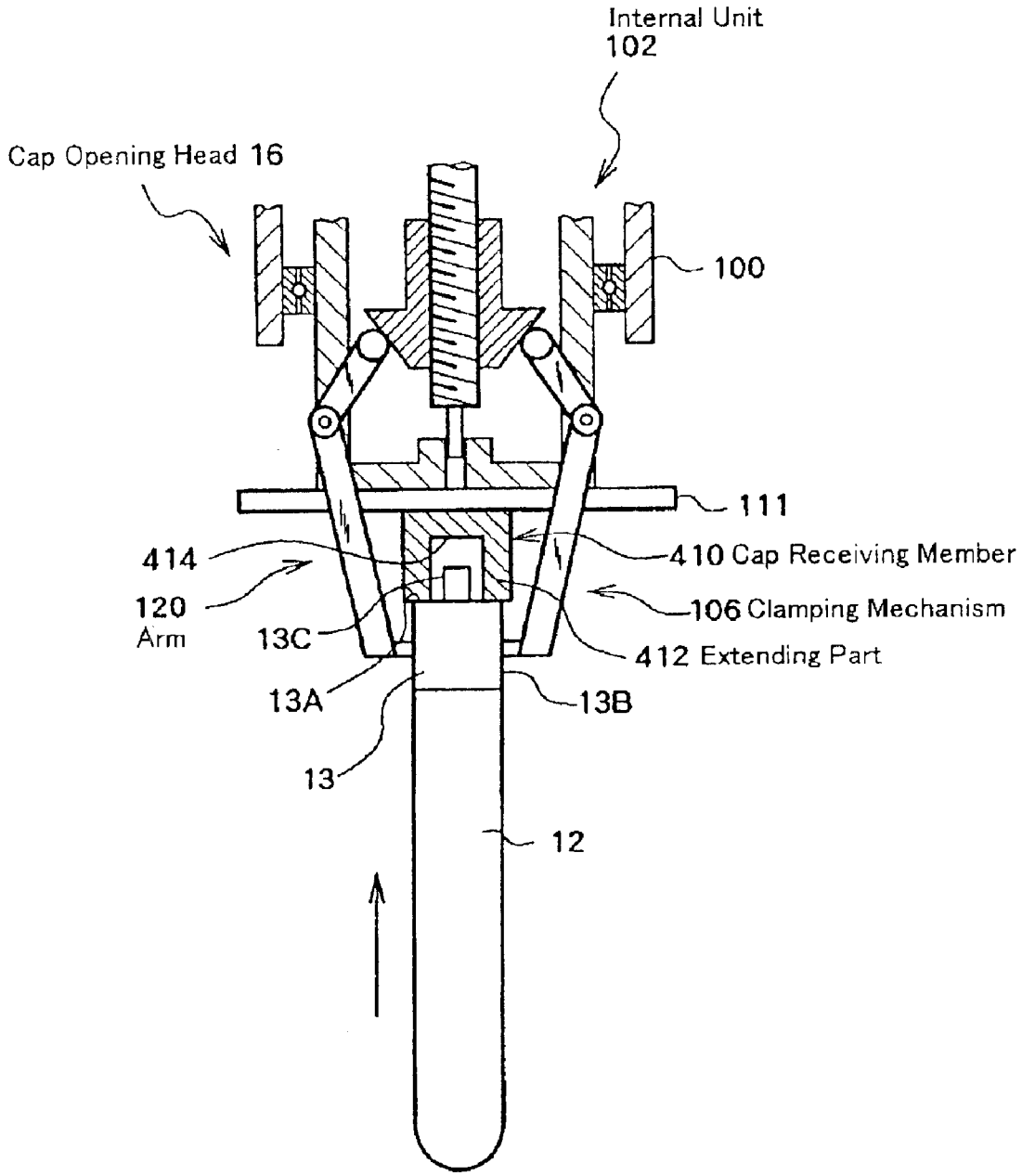
FIG. 15 is an illustration which shows the structure of a part of the cap handling apparatus according to the another embodiment of the present invention.

FIG. 15 shows the structure of a part of the cap opening head of this embodiment (in particular, the structure which is different from the embodiment shown in FIG. 6). A clamp mechanism 106 is constructed from a plurality of arms 120. In a space surrounded by these arms, that is a space defined below the cap opening head, a cap receiving member 410 is fixedly provided. The cap receiving member 410 may be formed of, for example, a metallic material or a resin material, and in the example shown in the drawing, it is fixedly mounted to the rotation preventing member 111. The cap receiving member 410 includes a concave part 414 which corresponds to the central portion of the cap and a cylindrical extending part 412 which is formed around the concave part 414 so as to extend downward.

In this embodiment, when the container body 12 is raised upward by the container body handling apparatus, the tip surface (in particular, the peripheral portion thereof) 13A of the cap 13 comes to abutment with the lower surface (abutment surface) of the extending part 412, so that the raising movement of the container body is forcedly stopped. At this time, the cap is positioned with respect to the cap opening head 16 at a proper height, that is it becomes possible to properly clamp the middle portion (circumferential surface) 13B of the cap 13. As is apparent from this structure, this embodiment has an advantage in that it is possible to determine the clamping position (height) based on the reference surface which is the top surface of the cap even though different thickness of the cap and different length of the container body 12. Further, in the example structure shown in the drawing, the cap receiving member 410 is formed with the concave part 414. Therefore, even in the case of a specific type cap in which a protruding portion is formed on the central portion of the top surface of the cap, positioning of the cap 13 can be carried out properly by receiving the protruding portion 13C into the concave part 414. Other structures and operations of this embodiment are basically the same as those of the embodiment shown in FIG. 6.

Figure 16:
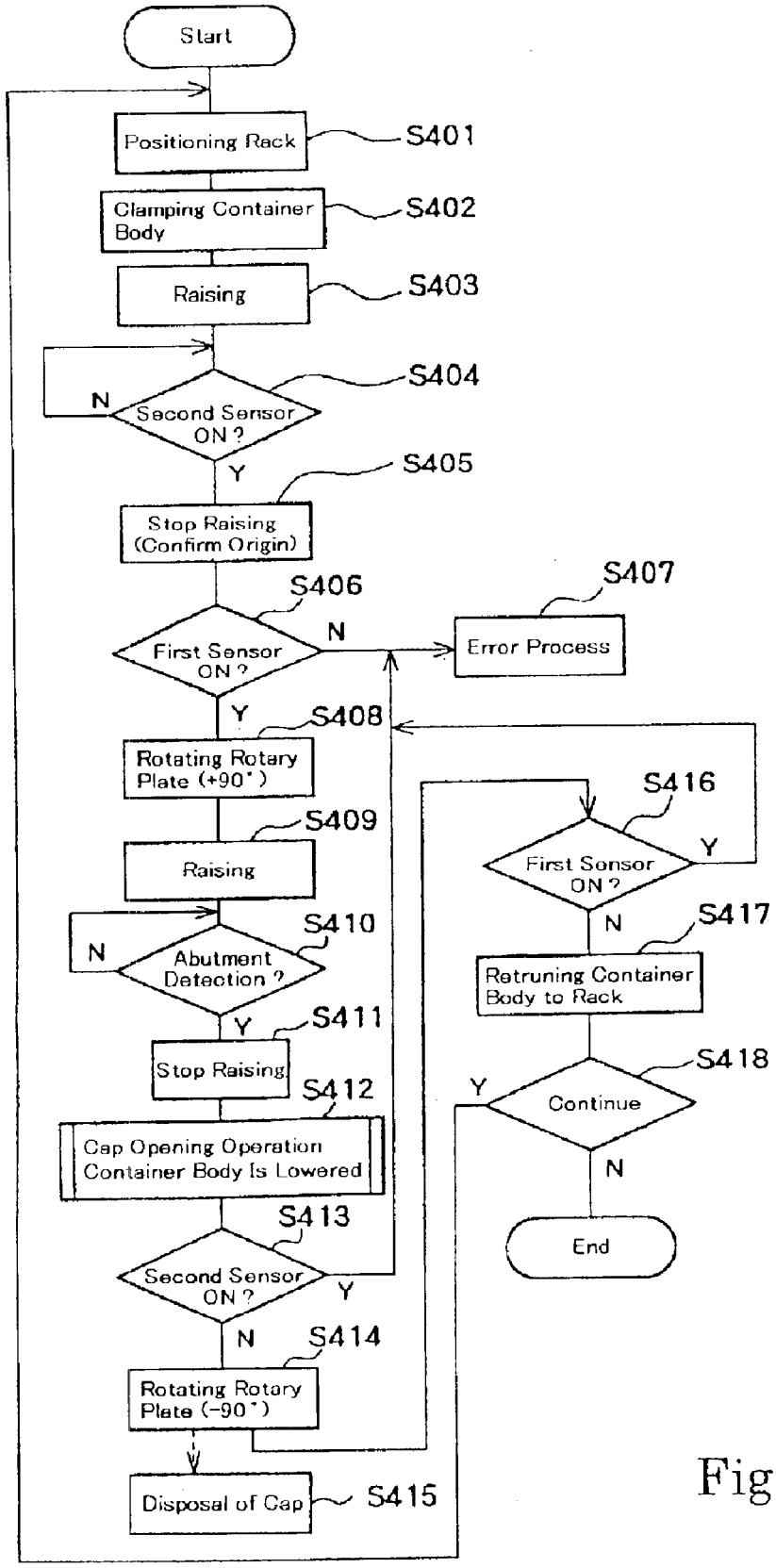
FIG. 16 is a flow chart for explaining the operation of the another embodiment of the present invention.

Next, referring to FIG. 13 and FIG. 15, operation of this embodiment will be described based on FIG. 16. In FIG. 16, Steps S401 to S408 are basically the same as Steps S101 to S108 in FIG. 9, and Step S412 to S418 in FIG. 16 are basically the same as Steps S110 to S116 in FIG. 9. Therefore, in the following, a description will be made particularly with reference to Steps S409 to S411 in FIG. 16.

At Step S409, the container body 12 is raised upward again from the state that the container body 12 is being temporarily stopped during the raising operation. At Step 410, a determination is made as to whether or not the abutment sensor 406 shown in FIG. 13 is turned on.

In this state, when the top surface of the cap abuts against the lower surface (that is, the abutment surface) of the cap receiving member 410 as shown in FIG. 15, the raising movement of the upper slide block 401 shown in FIG. 13 is prevented while the lower side block 402 continues its raising movement, so that the spring 404 is further compressed. In this case, since the spring 404 exhibits a resilient force, an impact when the cap 13 is abutted against the cap receiving member is damped. Namely, the spring 404 functions as a cushioning means. When the spring 404 is compressed over a predetermined degree, that is when the lower side block 402 closes to the upper slide block which has been stopped, the contact 402 contacts with the abutment sensor 406 to turn on it.

At this time, the upwardly raising movement of the container body 12 by the container body grasping unit 14 is stopped. Namely, the state that the cap is properly positioned is maintained. The operations after this step is the same as the operations shown in FIG. 9. For example, at Step S216, determination is made as to whether or not the cap is removed using the first sensor 18.

In the foregoing, the structure shown in FIGS. 13 to 16 is mere one example, and it goes without saying that various other structures can be adopted so long so they can achieve the same objects.

As described above, according to the present invention, it is possible to carry out a cap opening operation with high reliability. Further, according to the present invention, containers and caps having various sizes can be handled.

In addition, the cap opening system of the present invention makes it possible to realize a simple structure which can grasp a cap and then rotate it. Further, according to the present invention, it is possible to create a cap grasping force and a rotation force by a single driving source. Furthermore, according to the present invention, a cap is always rotated after a constant grasping force is exerted irrespective of sizes of caps.

Finally, it is to be noted that the present invention is not limited to the embodiments described above, and many changes and additions may be made within the spirit of this invention which is defined by the appended claims.

What is claimed is:

1. A cap opening system for automatically opening a cap of a container which includes a container body and the cap attached thereto, the system comprising:

a container body handling apparatus for holding the container body of the container to raise and lower it;

a cap handling apparatus arranged above the container body handling apparatus for grasping and then opening the cap of the container when the container body is raised; and positioning means for positioning the cap with respect to the cap handling apparatus, wherein:

the cap has a top surface defining a reference surface, and the positioning means positions the cap with respect to the cap handling apparatus based on the reference surface of the cap;

said positioning means includes a cap receiving member to which the top surface of the cap is adapted to abut, said cap receiving member being arranged underneath the cap handling apparatus, in which positioning of the cap is carried out by abutting the top surface of the cap against the cap receiving member;

wherein said cap receiving member has a central portion and a peripheral portion, in which a concave part is formed in the central portion and an extending part is formed in the peripheral portion thereof; and wherein a protruding portion is formed on the central portion of the top surface of the cap, and the concave part has size and shape that can receive the protruding portion therein.

2. The cap opening system as claimed in claim 1, wherein the container body handling apparatus includes an abutment detecting device for detecting abutment of the top surface of the cap against the cap receiving member, and a control section for stopping the raising operation of the container body when the abutment detecting device detects the abutment.

3. The cap opening system as claimed in claim 1, further comprising buffer means for damping impact by the abutment when the top surface of the cap abuts against the cap receiving member.

4. The cap opening system as claimed in claim 1, further comprising a first sensor which emits a vertical beam along the raising and lowering path of the cap, a second sensor which emits a horizontal beam which intersects the raising and lowering path of the cap at a predetermined height, and means for determining presence or absence of the cap based on the outputs of the first and second sensors.

5. The cap opening system as claimed in claim 4, wherein the raising operation of the container body is stopped when the horizontal optical beam is interrupted, and in this state the presence or absence of an object within a predetermined range in height is detected utilizing the vertical optical beam.

6. The cap opening system as claimed in claim 4, wherein the first sensor is positioned above the container body at least before the cap opening operation is carried out.

7. The cap opening system as claimed in claim 6, wherein the first sensor is positioned above the container body again when the cap opening operation has been carried out.

8. A cap opening system for automatically opening a cap of a container which includes a container body and the cap attached thereto, the system comprising:

a container body handling apparatus for holding the container body to raise and lower it;

a reference surface detector which detects a reference surface of the cap of the container when the container body is raised upward by the container body handling apparatus;

a cap handling apparatus for grasping and then opening the cap of the container; and means for controlling the operations of the container body handling apparatus and the cap handling apparatus to position the cap with respect to the cap handling apparatus based on the detected reference surface; wherein:

the cap has a top surface, and the reference surface is the top surface of the cap;

the reference surface detector includes a light emitting element and a light receiving element arranged at opposite sides of the raising and lowering path of the cap so that an optical beam is run between the light receiving and light emitting elements, in which the top surface of the cap is detected utilizing the interruption of the optical beam by the cap;

the top surface of the cap has a central portion and a peripheral portion which is located at a position shifted from the central portion in the horizontal direction, in which the light receiving and light emitting elements are arranged so that the optical beam is run across the peripheral portion, thereby enabling to detect the top surface of the cap irrespective of the shape of the central portion of the top surface of the cap.

9. The cap opening system as claimed in claim 8, wherein the means for controlling sets the height at which the reference surface is detected by the reference surface detector as a reference level and then raises the cap body by a predetermined distance, thereby positioning the cap with respect to the cap handling apparatus.

10. The cap opening system as claimed in claim 8, further comprising a cap presence or absence detector for detecting presence or absence of the cap.

11. The cap opening system as claimed in claim 10, wherein the cap presence or absence detector is positioned above the container body at least before the cap opening operation is carried out.

12. The cap opening system as claimed in claim 11, wherein the cap presence or absence detector is positioned above the container body again when the cap opening operation has been carried out.

13. The cap opening system as claimed in claim 11, wherein the cap presence or absence detector includes a reflection type optical sensor which detects the presence or absence of an object within a predetermined range in height.

14. The cap opening system as claimed in claim 1, wherein the container body handling apparatus comprises:

a pair of holding mechanisms, which are arranged opposite to each other so as to be capable of advancing or retracting, for holding a container body of a container from opposite sides of the container body which is supported by a rack; and a raising and lowering mechanism for raising and lowering the pair of holding mechanisms.

15. The cap opening system as claimed in claim 1, wherein the cap handling apparatus comprises a clamp mechanism for holding the cap, and a driving mechanism for driving the clamp mechanism so that the clamp mechanism is opened and closed as well as rotated.

16. A cap opening system for automatically opening a cap of a container which includes a container body and the cap attached thereto, the system comprising:

a container body handling apparatus for holding the container body of the container to raise and lower it;

a cap handling apparatus arranged above the container body handling apparatus for grasping and then opening the cap of the container when the container body is raised; and positioning means for positioning the cap with respect to the cap handling apparatus;

a movable member on which the cap handling apparatus is mounted; and means for driving the movable member so as to position the cap handling apparatus above the container body which is held by the container body handling apparatus when the cap is to be opened while positioning the cap handling apparatus above a cap disposal section when disposing of the cap.

17. The cap opening system as claimed in claim 16, wherein the movable member includes a rotary plate which is rotatable between a first angular position and a second angular position, in which the rotation angle of the rotary plate is set at the first angular position when the cap is to be opened and the rotation angle of the rotary plate is set at the second angular position when disposing of the cap.

18. The cap opening system as claimed in claim 17, wherein a cap presence or absence detector is mounted on the rotary plate, in which when the rotary plate is in the first angular position, the cap presence or absence detector is positioned at its evacuated position, while when the rotary plate is in the second angular position, the cap presence or absence detector is positioned above the container body held by the container body handling apparatus.

19. A cap opening system including a cap handling apparatus which comprises:

a base frame;

a rotary unit rotatably provided with respect to the base frame;

a plurality of arms provided on the rotary unit for grasping the cap; and a brake mechanism for restricting the rotation of the rotary unit, wherein the rotary unit comprises:

a rotary frame, a rotation shaft which is a shaft rotatably driven and provided so as to be capable of advancing or retracting with respect to the rotary frame with being biased toward the advancing direction, said shaft includes an engagement part which is to be engaged with the brake mechanism to release its rotation restricted state at a retracting position thereof, and a screw part; and a cam member threaded onto the screw part, and said cam member is adapted to move in an advancing direction by the forward rotation of the rotation shaft in the rotation restricted state of the rotary unit to cause the plurality of arms perform the grasping operation, and adapted to stop the advancing movement after the grasping operation has been completed to convert the forward rotational movement of the rotation shaft into a retracting movement of the rotation shaft, wherein by the forward rotational movement of the rotation shaft, the plurality of arms first perform the grasping operation and then the plurality of arms are rotated.

20. The cap opening system as claimed in claim 19, wherein the cam member is formed with an inclined surface on which a driving end of each arm slidably contacts, in which the driving ends of the respective arms are moved on the inclined surface according to the advancing movement of the cam member so that operating ends of the respective arms are operated so as to be closed.

21. The cap opening system as claimed in claim 19, wherein the brake mechanism comprises a brake plate, and biasing means which biases the brake plate in the advancing direction of the rotation shaft, wherein the rotation of the rotary unit is being restricted during the state that the brake plate is in contact with the rotary frame.

22. The cap opening system as claimed in claim 21, wherein the brake plate comes to release from the rotary frame from the point of time that a force caused by the retracting movement of the rotation shaft after the conversion exceeds the biasing force of the biasing means, thereby the rotation restricted state of the rotary frame is released.

23. The cap opening system as claimed in claim 19, further comprising rotation preventing means for preventing rotation of the rotary unit when the plurality of arms are operated so as to release the grasping cap, wherein by the reverse rotation of the rotation shaft, the cam member carries out the retracting movement with respect to the rotation shaft and the rotation shaft carries out the advancing movement.

24. The cap opening system as claimed in claim 23, wherein the rotation preventing means includes a polygonal member provided on the rotary unit, and a plurality of abutment members which abut the polygonal member to prevent its rotation.

25. The cap opening system as claimed in claim 23, wherein the rotary unit includes a positioning member to which the cap is to be abutted.

26. A cap opening system for automatically opening a cap of a container which includes a container body and the cap attached thereto, the system comprising:

a container body handling apparatus for holding the container body to raise and lower it;

a reference surface detector which detects a reference surface of the cap of the container when the container body is raised upward by the container body handling apparatus;

a cap handling apparatus for grasping arid then opening the cap of the container; and means for controlling the operations of the container body handling apparatus and the cap handling apparatus to position the cap with respect to the cap handling apparatus based on the detected reference surface;

a movable member on which the cap handling apparatus is mounted; and means for driving the movable member so as to position the cap handling apparatus above the container body which is held by the container body handling apparatus when the cap is to be opened while positioning the cap handling apparatus above a cap disposal section when disposing of the cap.

27. The cap opening system as claimed in claim 26, wherein the movable member includes a rotary plate which is rotatable between a first angular position and a second angular position, in which the rotation angle of the rotary plate is set at the first angular position when the cap is to be opened and the rotation angle of the rotary plate is set at the second angular position when disposing of the cap.

28. The cap opening system as claimed in claim 27, wherein a cap presence or absence detector is mounted on the rotary plate, in which when the rotary plate is in the first angular position, the cap presence or absence detector is positioned at its evacuated position, while when the rotary plate is in the second angular position, the cap presence or absence detector is positioned above the container body held by the container body handling apparatus.

* * * * *

UNITED STATES PATENT AND TRADEMARK OFFICE

CERTIFICATE OF CORRECTION

PATENT NO. : 6,871,566 B2
APPLICATION NO. : 10/252353
DATED : March 29, 2005
INVENTOR(S) : Niwayama et al.

It is certified that error appears in the above-identified patent and that said Letters Patent is hereby corrected as shown below:

On the Title page (56) under References Cited under FOREIGN PATENT DOCUMENTS, line 1, please replace "B37B/7/02" with --B67B/7/02--.
In column 1, line 28, please change "rotated for opening it" to --rotated for opening it.--
In column 9, line 33, please change "head 16 is, evacuated" to --head 16 is evacuated--
In column 14, line 38, please change "various other structures" to --various other structures.--
In column 24, line 65, please change "grasping arid then" to --grasping and then--

Signed and Sealed this

Twenty-ninth Day of January, 2008

JON W. DUDAS
*Director of the United States Patent and Trademark Office*